US006490846B2

(12) United States Patent
Koppe

(10) Patent No.: US 6,490,846 B2
(45) Date of Patent: Dec. 10, 2002

(54) OPENING ARRANGEMENT FOR ZIPPER-TYPE POUCHES FOR CONTINUOUS MOTION POUCHING MACHINERY

(76) Inventor: Robert G. Koppe, 3461 W. Shore Dr., Battle Creek, MI (US) 49017

( * ) Notice: Subject to any disclaimer, the term of this patent is extended or adjusted under 35 U.S.C. 154(b) by 0 days.

(21) Appl. No.: 09/952,106

(22) Filed: Sep. 14, 2001

(65) Prior Publication Data

US 2002/0050126 A1 May 2, 2002

Related U.S. Application Data

(63) Continuation of application No. 09/837,758, filed on Apr. 18, 2001

(60) Provisional application No. 60/198,943, filed on Apr. 21, 2000.

(51) Int. Cl.[7] ..... B65B 9/00; B65B 51/04

(52) U.S. Cl. ..... 53/459; 53/567; 53/139.2

(58) Field of Search ..... 53/459, 567, 468, 53/133.4, 139.2

(56) References Cited

U.S. PATENT DOCUMENTS 4,617,785 A * 10/1986 Chikatani et al. ..... 53/562
4,774,797 A * 10/1988 Colamussi et al. ..... 53/459
4,945,714 A * 8/1990 Bodolay et al. ..... 493/194
5,058,364 A * 10/1991 Seiden et al. ..... 53/385.1
5,996,319 A * 12/1999 Lerner et al. ..... 53/373.6
6,401,439 B1 * 6/2002 Tetenborg et al. ..... 53/567

* cited by examiner

*Primary Examiner*—John Paradiso
(74) *Attorney, Agent, or Firm*—Flynn, Thiel, Boutell & Tanis, P.C.

(57) ABSTRACT

An improved pouch-filling machine includes a pouch-opening apparatus for opening with closure strips such as zipper type locks in a continuous operation. The pouches are supported by continuously moving carriers, and the pouch-opening apparatus includes first and second stages wherein the first stage performs a preliminary opening of the upper edges of the pouch to permit gripping of the upper edges in the second stage. After this preliminary opening, the carrier carries the pouch to the second stage wherein a gripper arrangement grips and pulls the upper pouch edges outwardly to open the zipper lock. Further, the machine includes a transfer conveyor which continuously feeds the pouches to the pouch-opening apparatus in a vertical orientation.

20 Claims, 22 Drawing Sheets

OPENING ARRANGEMENT FOR ZIPPER-TYPE POUCHES FOR CONTINUOUS MOTION POUCHING MACHINERY

CROSS REFERENCE TO RELATED APPLICATIONS

This application claims the benefit of U.S. Provisional Application No. 60/198,943, filed Apr. 21, 2000 and is a continuing application of U.S. Patent Application Ser. No. 09/837,758, filed Apr. 18, 2001.

FIELD OF THE INVENTION

The invention relates to an apparatus for the automated filling of pouches, for example, with food products, and in particular to a pouch-opening apparatus for opening the pouches prior to filling.

BACKGROUND OF THE INVENTION

Bags or pouches are used for packaging numerous materials and products, such as dry and liquid food products. Such bags or pouches typically are formed from a sheet like material, such as a heat-sealable plastic or other suitable material. The bags or pouches may be preformed, or may be formed from a sheet of stock material at the beginning of the pouch making and filling process. In both cases, after the bags or pouches are filled with a selected filler through an open end thereof, the open end is then sealed shut such as by heat sealing.

U.S. Pat. No. 4,353,198 (Koppe) relates to a pouch forming and pouch-filling apparatus which is a "continuous" type filling machine by which the pouch is formed, handled, filled and sealed in a continuous operation. This machine represents an improvement over prior machines and in particular, those filler machines which perform an "intermittent" operation.

In the filler machine of the '198 patent, the pouches are gripped along the opposite side edges near the open upper end thereof by continuously-moving carriers which transfer the pouches from an initial pouch-forming apparatus to a pouch-filling apparatus. The upper edges of the pouch define the open end into which the filler is injected. Prior to reaching the filler machine, the upper edges of the pouch are spread open by a pair of vacuum units or suction cups.

However, the increasing use of releasable closure strips such as zipper type locks on such pouches has created problems for the known suction cup arrangement which encounters difficulties opening the pouch when the zipper lock is closed or engaged. Such releasable closure strips include mating sections which require a small but significant force to separate. Such zipper type locks are being used more frequently since consumers can reseal the pouch even after the original heat seal at the top edge of the pouch is cut open or broken.

It is an object of the invention to overcome the disadvantages associated with prior pouch-filling machines by providing a pouch-opening apparatus which readily opens pouches having resealable closure strips and primarily those having zipper type locks.

The invention therefore relates to a pouch-filling machine and more particularly to a pouch-filling machine which includes an improved pouch-opening apparatus. The pouch-opening apparatus not only accommodates pouches with zipper type locks but also opens such pouches in a continuous operation.

More particularly, the pouches are supplied to the pouch-opening apparatus through the belts of a pouch-transfer apparatus. As the pouches exit the pouch-transfer apparatus, the zipper lock typically is in a closed condition. At this time, a carrier picks up the pouch and carries the pouch to the pouch-opening apparatus which is located prior to or upstream of the pouch-filling apparatus.

To open the pouches, the pouch-opening apparatus preferably includes first and second stages wherein the first stage performs a preliminary opening of the upper edges of the pouch. The first stage spreads the upper flanges of the pouch outwardly to allow a pair of downwardly projecting fingertips to be placed into this opening and then travel with the pouch to a second stage. After this preliminary opening, the carrier carries the pouch to the second separating stage, which grips and pulls the upper edges outwardly to open the zipper lock.

In particular, the pouch-opening apparatus includes a spreader assembly having the downwardly projecting fingertips, which are inserted downwardly to separate the upper flanges above the zipper lock in the first stage. These fingertips define inner jaws that align with and press against outer jaws in the second stage, which outer jaws move separate from but parallel to the inner jaws. The inner and outer jaws grip the upper edges of the pouch whereby the cooperating jaws diverge outwardly to open the zippered pouch. The carrier thereafter holds the pouch in an opened condition for later filling at the pouch-filling apparatus.

The improved pouch-opening apparatus thereby opens the individual pouches in a continuous operation as the pouches are being carried from the initial pouch-transfer apparatus to the filling station.

The pouch-filling machine further includes an initial transfer apparatus for initially transferring or feeding the pouches to the pouch-opening apparatus. The transfer apparatus includes a stock of empty pouches on a feed table and a pick and place machine which picks the pouches from the feed table and rotates the pouches 90 degrees to a place position from which position the pouches are attached to a sideward-facing conveyor belt. The pick and place machine includes a drive system which translates the pick and place units parallel to and at the same translational rate as the conveyor belt so that the pouches may be placed onto the conveyor belt and held vertically in place by vacuum holes located on the conveyor belt. This arrangement provides a continuous feeding of pouches to the sideward-facing conveyor belt and supplies the pouches continuously to the pouch-opening apparatus.

Other objects and purposes, and variations thereof, will be apparent upon reading the following specification and inspecting the accompanying drawings.

Figure 1:
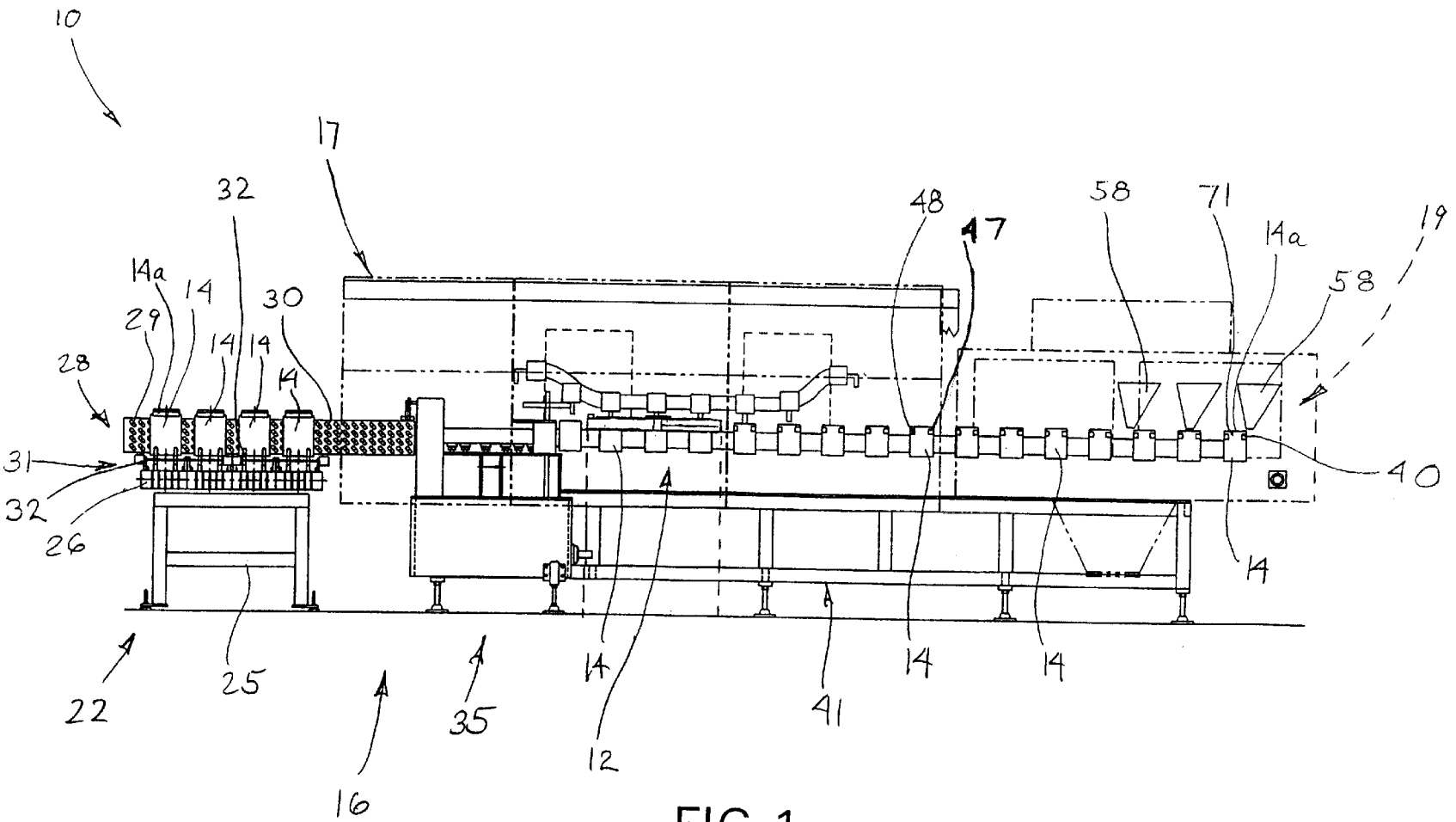
FIG. 1 is a front elevational view of a pouch-filling machine having a pouch-opening apparatus for zipper-type pouches.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Figure 2:
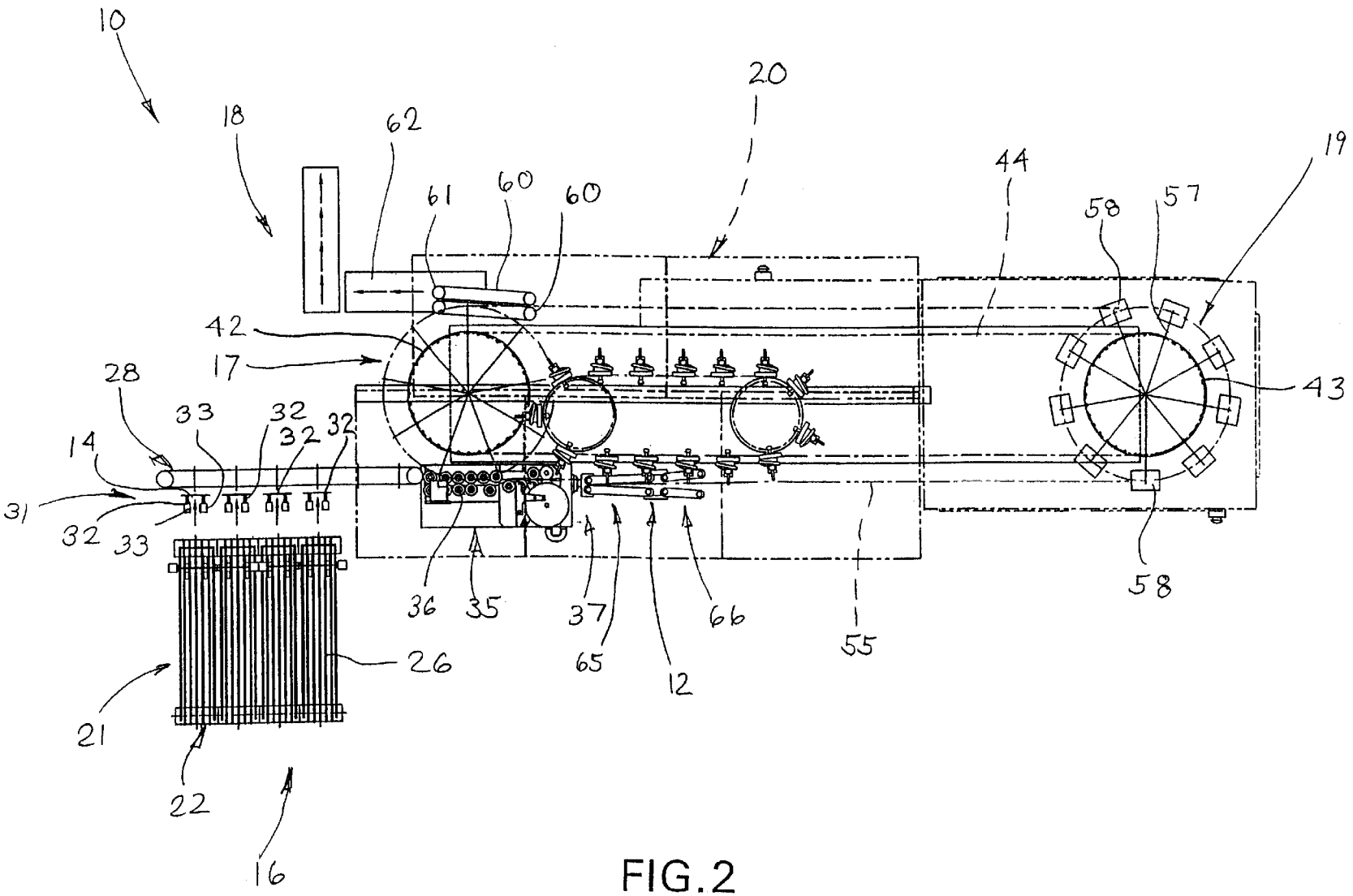
FIG. 2 is a plan view of the pouch-filling machine.

Referring to FIGS. 1 and 2, a multi-station pouch-filling machine 10 of the invention includes an improved pouch-opening apparatus 12 which opens flexible pouches 14 having resealable closure strips 15 (FIG. 16) in a continuous operation.

The pouch-filling machine 10 is an improvement over the pouch-filling machine disclosed in U.S. Pat. No. 4,353,198 (Koppe), the disclosure of which in its entirety is incorporated herein by reference. However, the pouch-filling machine 10 is still substantially the same in many respects as the machine of the '198 patent and thus, the following disclosure is directed in greater detail to the improvements over the prior machine.

Generally, the pouch-filling machine 10 includes multiple stations for transferring, filling and sealing the pouches 14 which are filled with a selected filler such as food or liquids. The multiple stations include: an initial transfer apparatus 16; a continuous-loop carrier apparatus 17 for carrying the pouches 14 to a final transfer apparatus 18; the pouch-opening apparatus 12 for opening the pouches 14 prior to filling; a pouch-filling apparatus 19 for filling the pouches 14; and a heat sealing apparatus 20 for sealing the pouches 14 prior to reaching the final transfer apparatus 18.

The overall arrangement and order of these stations is substantially the same as that disclosed in the '198 patent. Thus, only a general discussion of the structure and function of most of these stations is required herein.

Figure 16:
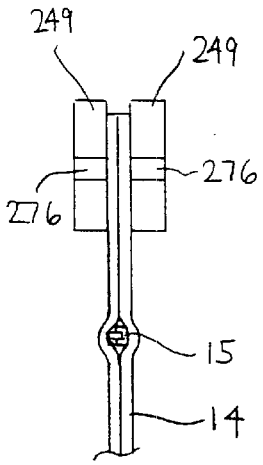
FIG. 16 is a diagrammatic end view of the first stage before upper flanges of a pouch are separated by a vacuum unit.

More particularly, the pouch-filling machine 10 is used to fill pre-formed pouches 14 which are closed on three edges but have an open upper end 14*a* (FIG. 16). Unlike the pouches disclosed in the '198 patent wherein suction cups serve to open the upper end of each pouch prior to filling, the pouches 14 include resealable closure strips 15 which create difficulties for the prior suction cup arrangement.

The resealable closure strips 15 typically are zipper locks as illustrated herein although other types of resealable closure strips may be provided such as Velcro or one or more resealable strips of adhesive. These strips allow consumers to reseal the package during use to prevent spillage and/or maintain freshness.

Such pouches 14, however, are more difficult to open during the filling operation since the closure strips 15 are typically in a locked condition when picked up by the carrier apparatus 17. Thus, the known suction cups are unable to overcome the engagement force required to open the closure strips.

The zipper locks 15 illustrated herein in FIGS. 16–19 extend horizontally across the width of the pouch 14 and include mating female and male sections 15*a* and 15*b*. While the mating sections 15*a* and 15*b* are separable, typically a relatively small but significant force is required to disengage the mating sections 15*a* and 15*b* and fully open the pouch 14. The improved pouch-opening apparatus 12, however, is able to open such closure strips and overcome the difficulties associated therewith.

The following is a more detailed discussion of the individual components of the pouch-filling machine 10.

INITIAL TRANSFER APPARATUS

With respect to the individual stations, the first station is the initial transfer apparatus 16, which includes a stock 21 of empty pouches 14 arranged in four parallel rows on a horizontal feed table 22. The feed table 22 includes a support frame 25, which supports a horizontal bed 26 on which the four rows of pouches 14 are provided. The pouches 14 lie generally horizontally and are moved toward a transfer conveyor 28.

The transfer conveyor 28 is in a vertical orientation wherein the conveyor 28 includes a sideward-facing conveyor belt 29. The conveyor belt 29 is perforated by a plurality of vacuum holes 30 for holding the pouches 14 thereon in a generally vertical orientation.

The transfer station 16 further includes a pick and place machine 31 having four pick and place units 32 which each include a pair of vacuum units 33 thereon for picking up the pouches 14 from the feed bed 26 and placing the pouches 14 onto the conveyor 28. The pick and place units 32 rotate 90 degrees between a pick position and a place position.

More particularly, FIG. 1 illustrates the pick and place units 32 in the pick position wherein the vacuum units 33 project downwardly to pick up a corresponding one of the pouches 14 from the feed bed 26. Thereafter, the pick and place units 32 rotate 90 degrees so that the vacuum units 33 are directed toward the conveyor belt 29 and the empty pouches 14 are in facing relation with the belt 29.

The pick and place units 32 then move the pouches 14 toward the opposing conveyor belt surface wherein the individual pouches are held on the belt 29 by the vacuum holes 30. The pouches 14 are fed continuously onto the conveyor belt 29 in groups of four, and the transfer conveyor 28 then moves the pouches 14 continuously to a feed belt unit 35 which is disposed downstream therefrom.

The feed belt unit 35 includes a plurality of rollers 36 which each rotate about a vertical axis, wherein the rollers 36 drive belts to receive the pouches 14 from the outlet end of the conveyor 28. At the downstream end 37 of the belt unit 35, the carrier apparatus 17 picks up the individual pouches 14.

The carrier apparatus 17 thereafter transfers the pouches 14 downstream to the pouch-filling apparatus 19 and then to the final transfer apparatus 18 as will be discussed herein.

While the pouch-filling machine 10 of the invention includes the above-described transfer apparatus 16 which is specifically constructed to handle pre-formed pouches 14, the pouches 14 also may be formed on site. For example, afore-mentioned U.S. Pat. No. 4,353,198 discloses a pouch-forming apparatus that forms a plurality of separate pouches from a continuous sheet or roll of plastic pouch material. If desired, the pouch-filling machine 10 of the present invention may be modified by replacing the transfer apparatus 16 with the pouch-forming apparatus and pouch-transfer apparatus of the '198 patent.

The initial transfer apparatus, and specifically, the feed table 22, pick and place machine 31 and transfer conveyor 28 are discussed in greater detail hereinafter.

CARRIER APPARATUS

With respect to the carrier apparatus 17 disclosed herein, this apparatus is substantially the same as that disclosed in the '198 patent. Accordingly, the following discusses the structural and functional operation of the carrier apparatus 17. A more detailed disclosure with respect to this apparatus is provided in the '198 patent which has been incorporated herein by reference.

The conveyor apparatus 17 provides an endless loop of individual carriers 40 (FIG. 5A) which each pick up a respective pouch 14 from the initial transfer apparatus 16 and carry same downstream to the pouch-filling apparatus 19 as generally illustrated in FIG. 1.

More particularly, the pouch-filling machine 10 includes a machine frame 41, and the carriers 40 are driven by a pair of sprocket or hub assemblies 42 and 43 (FIG. 2) which are supported on the machine frame 41 proximate the opposite ends of the pouch-filling machine 10. The sprocket assemblies 42 and 43 drive an endless drive chain 44 as diagrammatically illustrated in FIG. 2.

Figure 5A:
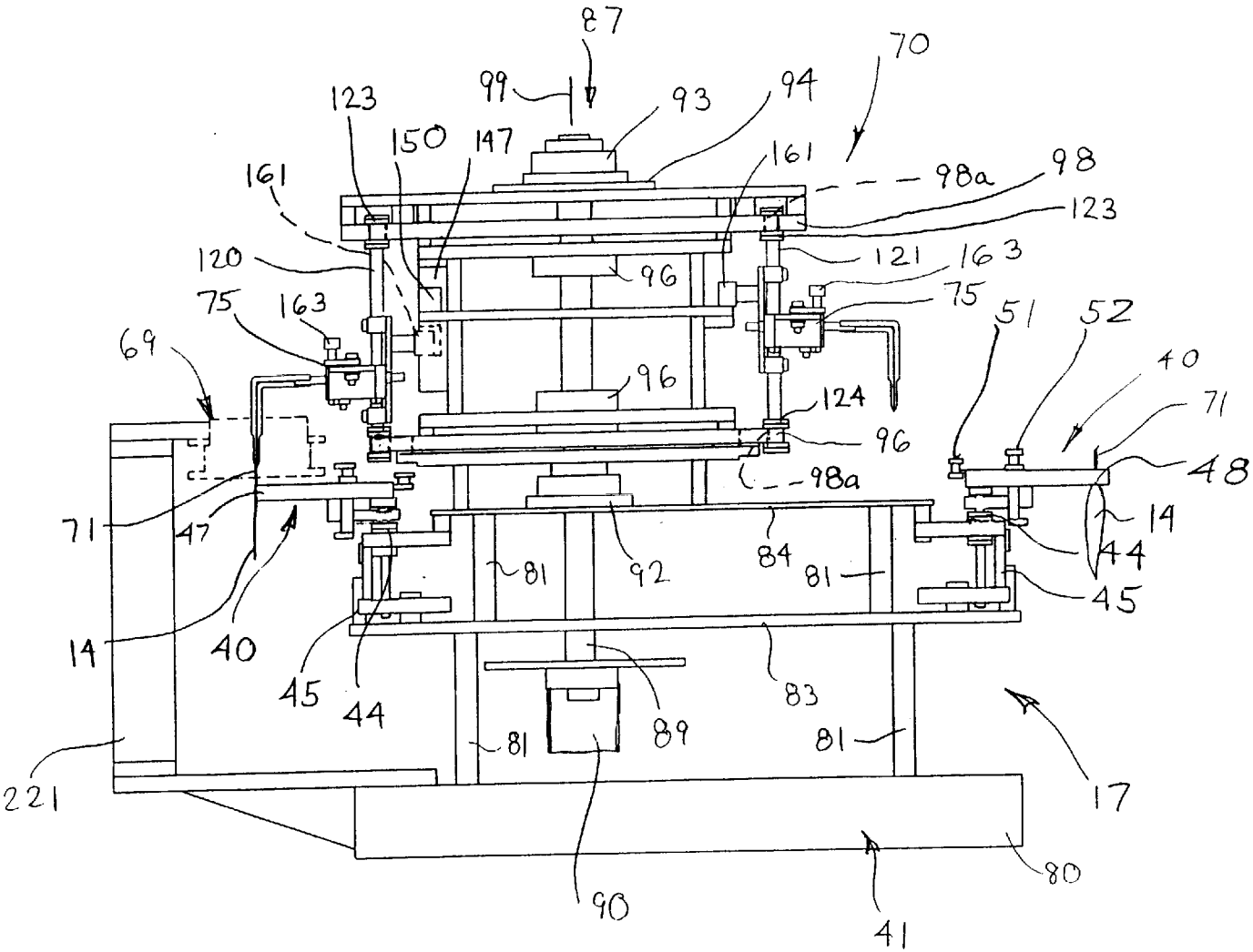
FIG. 5A is an end elevational view of the pouch-filling machine and the pouch-opening apparatus thereof.

Referring to FIG. 5A, each of the carriers 40 is operatively connected to the drive chain 44 and slidably supported on the frame 41 through a connector assembly 45. Thus, rotation of the sprocket assemblies 42 and 43 effects movement of the endless chain 44 to continuously move the carriers 40 sidewardly about a closed-loop path.

Figure 13:
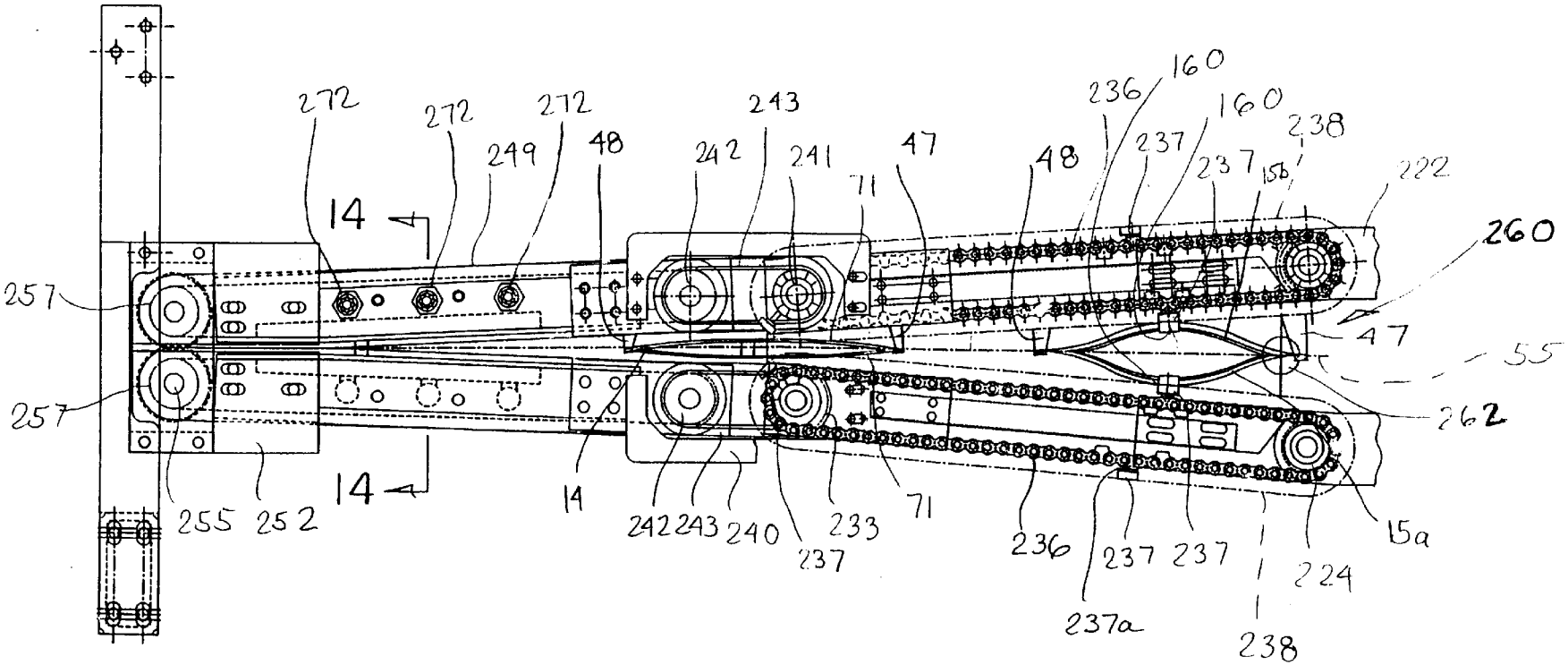
FIG. 13 is a plan view of the base unit.

To grip a pouch 14, each of the carriers 40 includes a pair of leading and trailing arms 47 and 48 that project radially outwardly and are generally horizontal. The outer ends of the leading and trailing arms 47 and 48 effectively define grippers for gripping the opposite side edges of a respective one of the pouches 14 as illustrated in FIG. 13. The ends of the arms 47 and 48 travel through an endless loop that defines a path 55 through which the pouches 14 travel as seen in FIG. 2.

To open and close the grippers of the arms 47 and 48 in order to grab the opposite side edges of a pouch 14, a cam follower or roller 51 is provided. Further, a second cam follower or roller 52 is provided to move the arms toward and away from each other in a generally horizontal plane.

Accordingly, as each pouch 14 is discharged from the downstream outlet end 37 of the belt unit 35, the cam roller 51 is actuated to open and close the jaws of the arms 47 and 48 to effect gripping of the opposite side edges of the pouches 14 above the zipper lock 15. As such, the pouches 14 are suspended downwardly from the arms 47 and 48. Each individual carrier 40 as it passes the belt unit 35 grips a respective one of the pouches 14. Since the ends of the arms 47 and 48 define the pouch path 55, the lateral width of the pouches 14 defines a transverse centerline of the pouch 14 which is coaxial with and defines the pouch path 55.

The pouches 14 are subsequently opened by the pouch-opening apparatus 12 as will be discussed herein. To hold the pouch 14 open after the pouch-opening step has been performed, the cam roller 52 is actuated so that the arms 47 and 48 move toward each other from a spread apart position (generally illustrated in the center of FIG. 13) to a closed position (generally illustrated on the right end of FIG. 13). Since the lateral width of the pouches 14 between the side edges is made shorter by this movement of the arms 47 and 48, the upper edges of the pouch 14 which have already been separated bow outwardly away from each other and are maintained in this open position.

After filling and sealing, the cam roller 51 is again actuated to release the filled and sealed pouch 14 which pouch is removed by the final transfer apparatus 18. The structure and operation of the cam rollers 51 and 52 is disclosed in greater detail in the '198 patent.

POUCH-FILLING APPARATUS

After pickup and opening, the pouches 14 are then transferred to the pouch-filling apparatus 19 (FIGS. 1 and 2). The pouch-filling apparatus 19 includes a rotating turret-like hub assembly 57 having a plurality of circumferentially spaced apart funnels 58. Each funnel 58 includes a downwardly opening spout for filling of the individual pouches 14.

The hub assembly 57 rotates continuously so that movement of the funnels 58 corresponds to movement of the pouches 14 along the pouch path 55. The pouches 14 may be filled with any desirable material such as food and liquid products.

SEALING APPARATUS

Thereafter, the carriers 40 continue to move the pouches 14 along the pouch path 55 to the sealing apparatus 20. The sealing apparatus 20 heats and cools each pouch 14 along the upper margins thereof to form a heat seal.

FINAL TRANSFER APPARATUS

The sealed pouches 14 then are transported to the final transfer apparatus 18 for bulk packaging and shipping. More particularly, the final transfer apparatus 18 includes a pair of parallel discharge conveyors 60 (FIG. 2) which are oriented vertically in opposing relation and effectively grab the filled pouches 14 between the belts of the conveyors 60. The pouches 14 travel along the discharge conveyors 60 to an upstream end 61 whereupon the pouches 14 are deposited onto an upward facing first conveyor 62. The first conveyor 62 then discharges the pouches 14 onto a second conveyor 63 that is oriented transverse to the first conveyor 62. At the outlet end of the second conveyor 63, the pouches 14 are bulk-packaged for shipping.

POUCH-OPENING APPARATUS

The pouch-filling machine 10 disclosed herein further includes the improved pouch-opening apparatus 12 that replaces the prior suction cup arrangement which had previously been used. The pouch-opening apparatus 12 readily accommodates pouches 14 having resealable closures strips 15 such as a zipper type lock. For illustrative purposes, the following discussion primarily refers to the resealable closure strips as a zipper lock although other types may also be used.

Figure 3A:
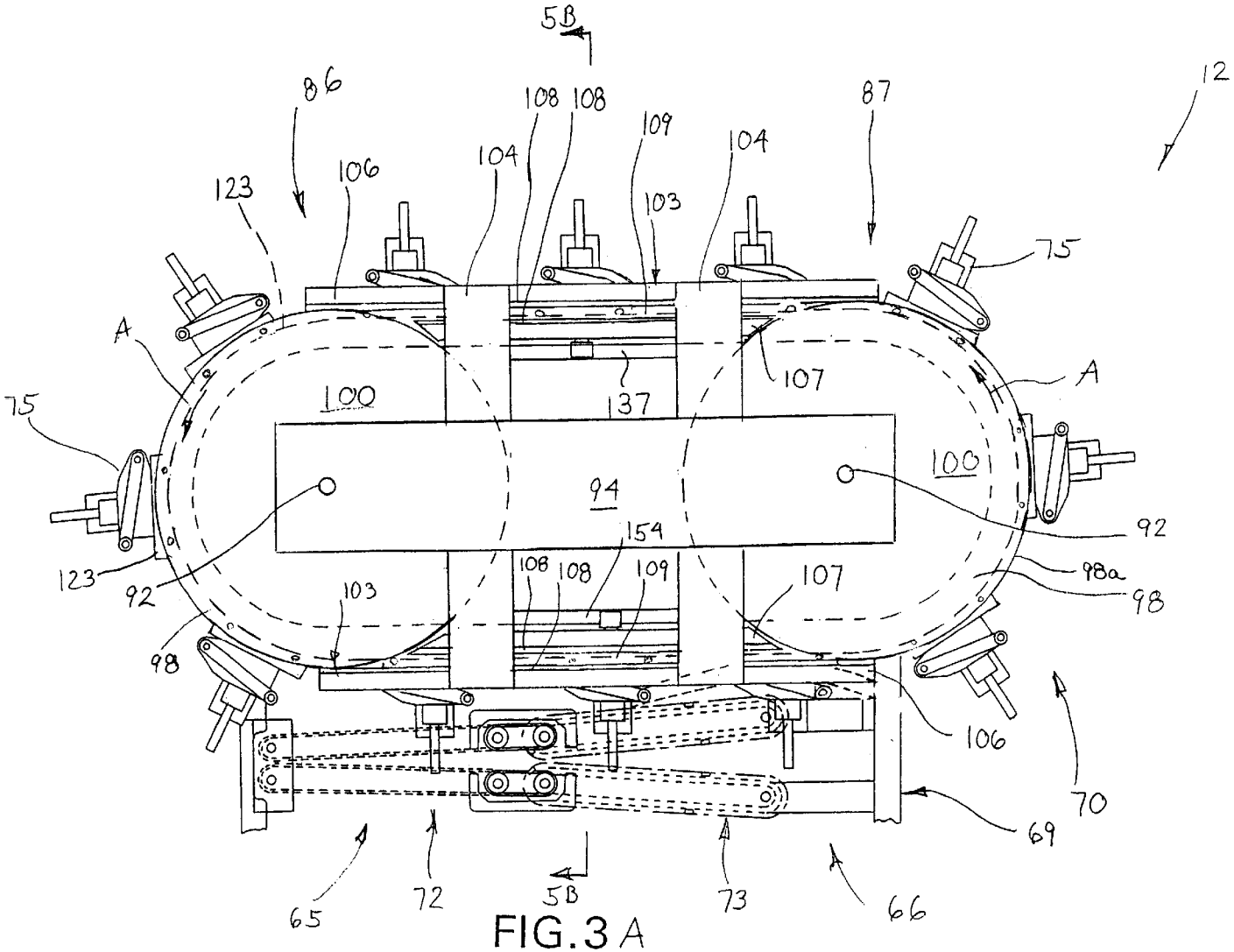
FIG. 3A is a plan view of the pouch-opening apparatus.

More particularly, the pouch-opening apparatus 12 is located upstream of the pouch-filling apparatus 19 so that the pouches 14 are opened prior to filling. Referring to FIGS. 2 and 3A, the pouch-opening apparatus preferably includes two stages, namely a flap separation stage 65 to permit an initial insertion of fingertips 160, and a pouch gripping and spreading stage 66 wherein the upper edges 71 of each pouch 14 are gripped and pulled apart. These two stages operate continuously in that the pouches 14 are opened during the continuous movement of the carriers 40, thus avoiding the disadvantages associated with "intermittent" type machines.

Figure 4:
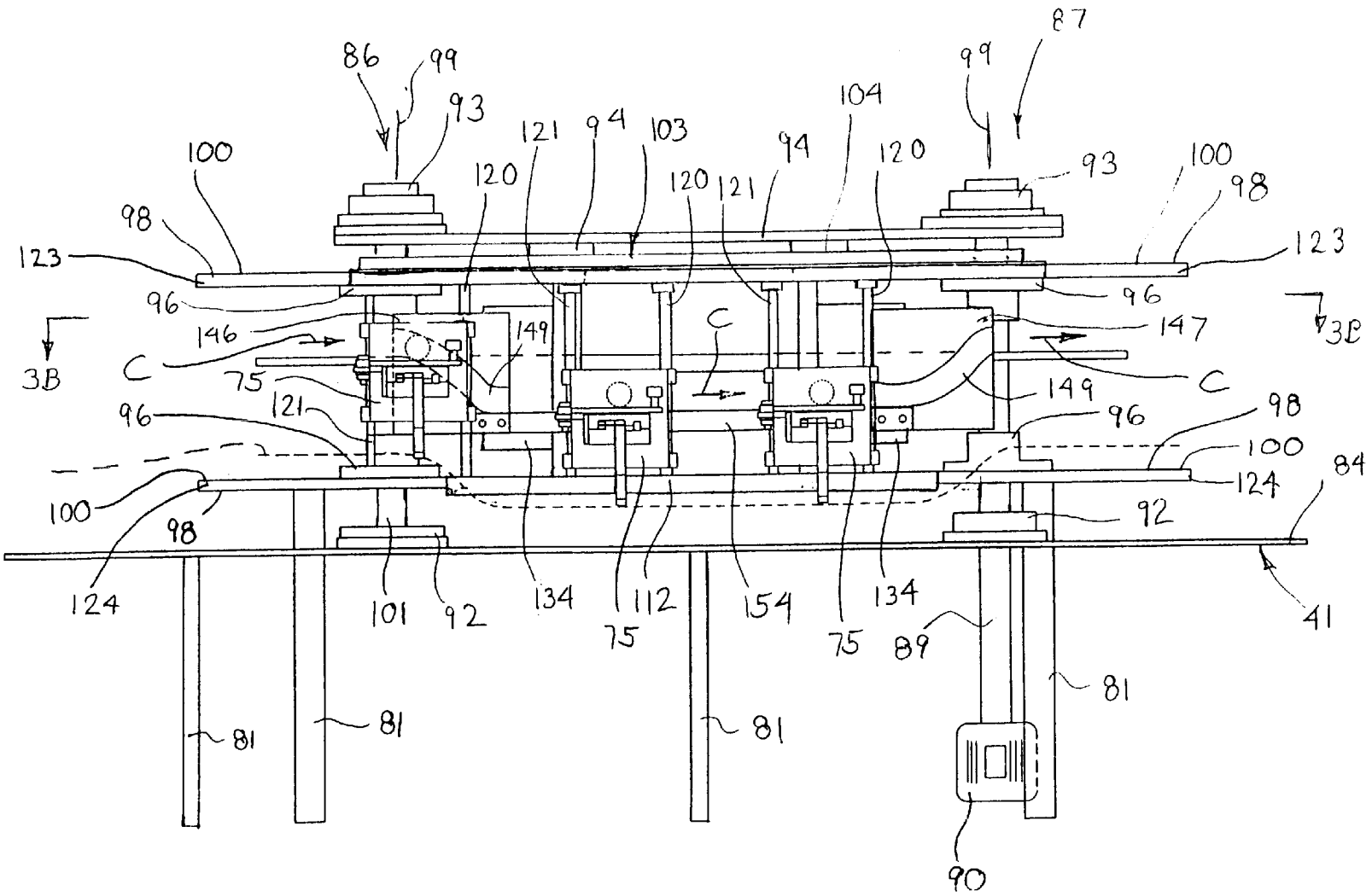
FIG. 4 is a front elevational view of the pouch-opening apparatus.

Referring to FIGS. 3A, 4 and 5A, the pouch-opening apparatus 12 includes a base unit 69 and a carousel unit 70. Generally, the base unit 69 extends horizontally at an elevation corresponding to the upper edges 71 of the pouch 14 as seen in FIG. 5A.

As seen in FIG. 3A, the base unit 69 includes a continuously moving vacuum assembly 72 which performs the flap separation stage 65, and an outer jaw assembly 73 which forms part of the pouch gripping and spreading stage 66. The outer jaw assembly 73 cooperates with spreader assemblies 75 on the carousel unit 70 to effect a gripping of the pouch 14 as described in further detail herein.

The following is a more detailed description of the carousel unit 73 and the vacuum unit 72.

1. Carousel Unit

The carousel unit 70 moves the spreader assemblies 75 horizontally in an annular or closed loop path which corresponds to the movement of the carriers 40. The carousel unit 70 also effects vertical movement of the spreader assemblies 75 as discussed in further detail herein to open the pouches 14.

The carousel unit 70 is supported on the machine frame 41. Referring to FIGS. 4 and 5A, the frame 41 includes a base pad 80 and upstanding support posts 81, which project upwardly to support a lower support plate 83 and an upper support plate 84, which is spaced upwardly therefrom. Generally, the lower support plate 83 supports the carrier apparatus 17 as generally seen in FIG. 5A, while the upper support plate 84 supports the carousel unit 70 thereon.

The carousel unit 70 includes a pair of laterally spaced apart hub units 86 and 87 which define an endless loop drive arrangement for effecting movement of the spreader assemblies 75. As discussed herein, the spreader assemblies 75 are themselves joined together in an endless loop, wherein the hub units 86 effectively define sprocket-like arrangements. Accordingly, rotation of the hub units 86 effects movement of the spreader assemblies 75.

To effect a driving movement of the spreader assemblies 75, the hub units 86 and 87 are substantially identical except that the hub unit 86 is a driven unit while the hub unit 87 is a drive unit. In particular, the hub unit 87 includes a drive shaft 89 which projects downwardly below the support plate 84 and is driven by a motor 90. Other than this difference in the drive shaft 89, the hub units 86 and 87 are identical and thus, the same reference numerals are used for common components.

The drive shaft 89 is rotatably connected to a lower bearing 92 which is supported on the support plate 84, and an upper bearing 93 which is connected to a top plate 94 of the machine frame 41. Shaft 89 further includes upper and lower drive collars 96 which are fixedly connected to the drive shaft 89 so as to rotate therewith. Each drive collar 96 supports a sprocket-like drive disk 98 which is oriented horizontally for rotation about a vertical rotation axis 99 as generally indicated by reference arrows A in FIG. 3A.

Upon rotation of the drive shaft 89, the drive disks 98 rotate in unison therewith. Each drive disk 98 includes sprocket teeth diagrammatically identified by reference numeral 98a about the outer circumference thereof and thereby defines an upper surface 100 which provides vertical support to the spreader assemblies 75 during movement thereof as will be described herein.

The other hub unit 86 is substantially identical to the hub unit 87 except that its rotation shaft 101 has a shorter vertical length extending between the lower and upper bearings 92 and 93.

To provide vertical support as the spreader assemblies 75 move horizontally across the region between the drive disks 98, the carousel unit 70 includes upper guide rails 103 which extend tangentially between the laterally spaced apart drive disks 98. The upper guide rails 103 are supported on the machine frame 41 which frame 41 includes cross rails 104 that are laterally spaced apart and extend transversely relative to the top plate 94. The outer ends of the cross rails 104 support the upper guide rails 103 thereon by suitable fasteners.

More particularly, each of the upper guide rails 103 is formed by generally L-shaped outer and inner rail walls 106 and 107. The outer and inner rail walls 106 and 107 project downwardly from the cross rails 104 and then project horizontally toward each other so that each of the rail walls 106 and 107 defines an upward facing support ledge 108 while an elongate channel 109 is defined horizontally therebetween.

Each channel 109 opens downwardly along its horizontal length and also opens sidewardly from the opposite ends of the guide rail 103 toward the drive disks 98. The support ledges 108 and the outer circumferential edges of the disk surfaces 100 thereby are aligned with each other to provide vertical support to the spreader assemblies 75 and define an annular or closed loop path along which the spreader assemblies 75 move as will be discussed herein.

Figure 3B:
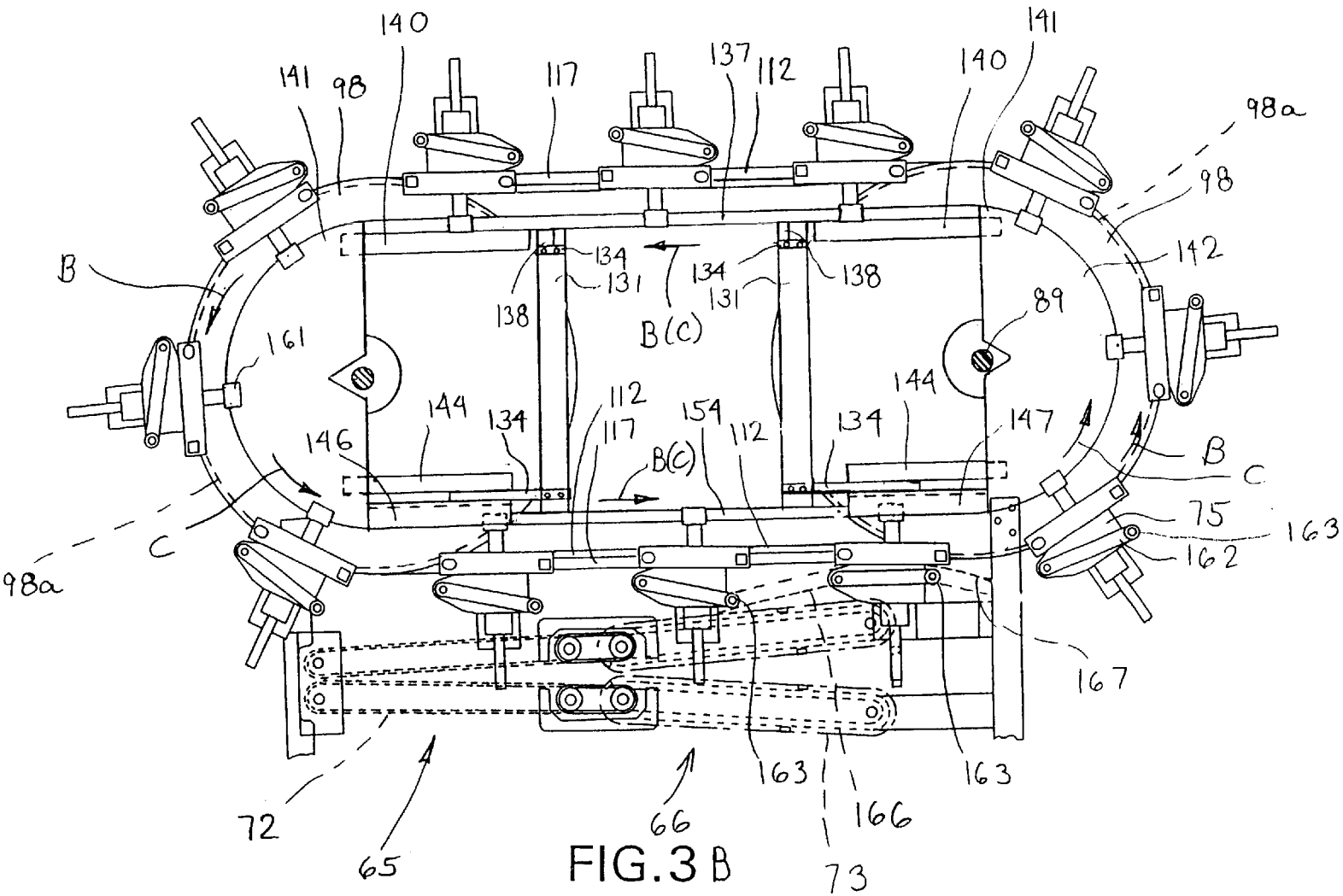
FIG. 3B is a plan view of the pouch-opening apparatus in cross-section as taken along line 3B—3B of FIG. 4.
Figure 5B:
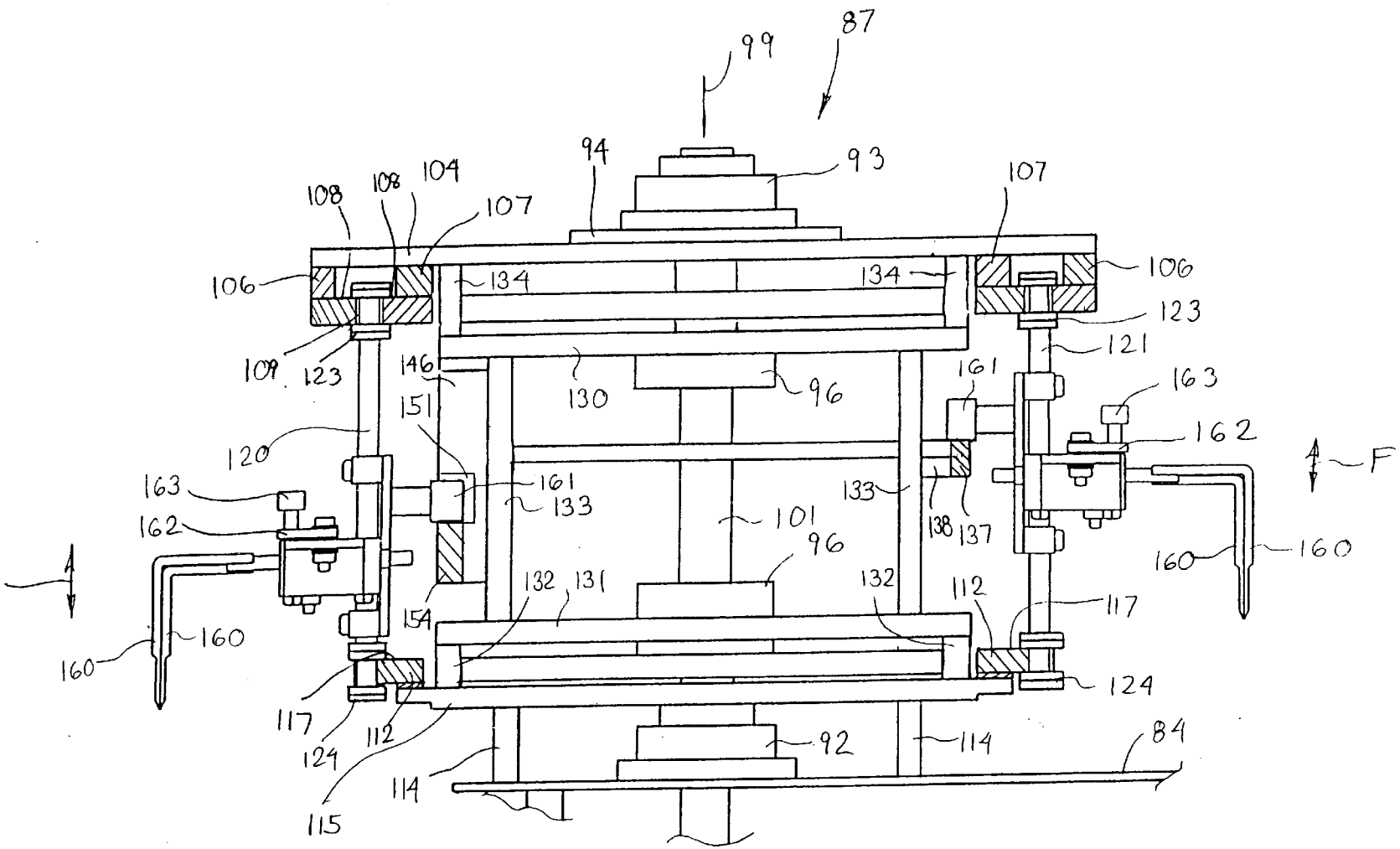
FIG. 5B is an enlarged end elevational view of the pouch-opening apparatus in cross-section as taken along line 5B—5B of FIG. 3A.
Figure 6:
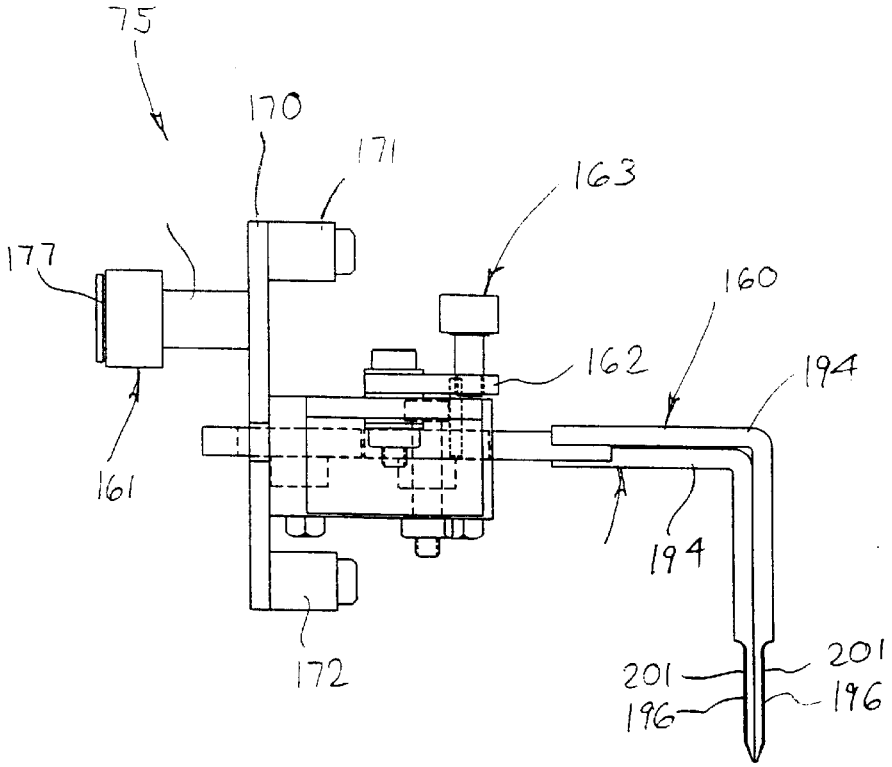
FIG. 6 is a side elevational view of a spreader assembly having fingertips thereof in a closed position.

The carousel unit 70 further includes lower guide rails 112 which are generally illustrated in FIGS. 3B, 4 and 5B. To support the lower guide rails 112, the frame section 41 further includes upstanding support posts 114 which project upwardly from the support plate 84 and include a further support plate 115 on the upper ends thereof.

The outer edges of the support plate 115 have the lower guide rails 112 fixedly supported thereon. The lower guide rails 112 are generally L-shaped and project horizontally outwardly to define further upward facing support ledges 117 on the front and back of the carousel unit 70.

In order to support the individual spreader assemblies 75 while permitting movement of the spreader assemblies 75 about their annular path, each of the spreader assemblies 75 is supported on a pair of circumferentially spaced apart vertical guide rods 120 and 121. Each of the guide rods 120 and 121 is supported at the upper and lower ends by drive chain 123 and drive chain 124 respectively. Connector pins project vertically through the chains 123 or 124 into engagement with the ends of the rods 120 and 121. The drive chains 123 and 124 project radially outwardly from the outer circumference of the columns 120 and 121 to effect horizontal movement while providing vertical support thereto.

More particularly, the upper drive chain 123 is slidably received in the upper guide rails 103.

Specifically, the drive chain 123 is vertically supported on and rides along the support ledges 108 of the upper guide rail 103 as well as the outer circumference of the top drive disks 98.

Further, the lower drive chain 124 is vertically supported on and rides along the support ledge 117 of the lower guide rail 112 and along the outer circumferential edge of the lower drive disks 98.

The guide rods 120 and 121 thereby travel about a closed loop path indicated generally by reference arrows B in FIGS. 3A and 3B.

While the parallel guide rods 120 and 121 slide horizontally along the annular path B, the horizontal spacing between the guide rods 120 and 121 is constant. In particular, the guide rods 120 and 121 are connected together by the endless drive chains 123 and 124 which are fixedly connected to the guide rods 120 and 121 and moves therewith. Thus, driving of the drive shaft 89 by the motor 90 effects rotation of the drive disks 98 on both of the hub units 86 and 87 in the direction of arrows A which thereby effects a corresponding horizontal movement of the spreader assemblies 75 which are supported on the guide rods 120 and 121.

The horizontal spacing and speed of the spreader assemblies 75 corresponds to the carriers 40. As a result, each of the spreader assemblies 75 is aligned with and travels in unison with the corresponding one of the carriers 50 during the pouch-opening stage.

In addition to the above-described horizontal movement of the spreader assemblies 75, the spreader assemblies 75 also are movable vertically in the direction of reference arrows F (FIG. 5B). Referring to FIGS. 4 and 5A, the spreader assemblies 75 are maintained in a raised position along most of their annular path as generally indicated on the right side of FIG. 5A, but then dip to a lowered position near the base unit 69 to open the pouches 14 as generally illustrated in FIG. 4.

Since the spreader assemblies 75 are freely slidable along the guide rods 120 and 121, it is necessary to provide an annular track which provides vertical support to the spreader assemblies 75. The annular track is identified generally by reference arrows C in FIGS. 3A and 4.

More particularly, the machine frame 41 includes additional framework including horizontal cross rails 130 and 131 which are vertically supported on the support plate 115 by spacer blocks 132. Also, upright spacer plates 133 are provided, and the cross rail 131 is connected to the top cross rails 104 by additional vertical spacers 134.

To define the raised section of the track, a horizontal support rail 137 is suspended from the vertical plates 133 by spacer blocks 138 and defines a linear track section. The support rail 137 extends along the backside of the carousel unit 70 and is generally parallel to but spaced radially inwardly from the upper guide rails 103.

The support rail 137 includes support brackets 140 on the opposite ends thereof which are rigidly connected to cam plates 141 which are formed in a half circle. The cam plates 141 have a smaller radius than the drive disks 98. As such, the outer circumferential edges 142 of the cam plates 141 are spaced radially inwardly from the outer circumferential edges of the drive disks 98, the edges 142 define arcuate track sections on the left and right ends of the carousel unit 70 which align with the linear track section on the back thereof.

Additional support brackets 144 are fixedly connected to the front vertical plates 134. The additional support brackets 144 extend sidewardly and rigidly support the front sections of the cam plates 141. The outer circumferential edges of the cam plates 141 as well as the top surface of the support rail 137 thereby define a raised section of track for the spreader assemblies 75.

To lower and then raise the spreader assemblies 75 in the region of the base unit 69, a declined transition block 146 and an inclined transition block 147 are connected to the left and right front plates 134 as illustrated in FIG. 4. Each transition block 146 and 147 is relatively thick and is formed with a generally S-shaped groove 149 on the front face thereof. Each of the grooves 149 opens forwardly from the front thereof and also opens sidewardly from an upper end 150 and a lower end 151.

Each of the grooves 149 thereby defines a ramp which raises or lowers the spreader assemblies 75 as required. To define a horizontal support surface for the spreader assemblies 75 which extends between the transition blocks 146 and 147, a lower support rail 154 is bolted onto the lower ends of the transition blocks 146 and 147. The upper surface of this support rail 154 defines a linear section of track and extends substantially flush with the lower surfaces of the grooves 149. As a result, a continuous annular track or cam surface is defined generally about the periphery of the carousel unit 70 which cam surface effects raising and lowering of the spreader assemblies 75.

In view of the foregoing, each spreader assembly 75 not only moves horizontally but also moves vertically on the carousel unit 70.

Turning now to the individual spreader assemblies 75, each of the spreader assemblies 75 includes spreadable fingertips 160 (FIG. 5B) which project outwardly and then downwardly. The spreader assemblies 75 function by being moved downwardly to insert the fingertips 160 between the upper pouch edges 71 just above the individual strips 15*a* and 15*b* of the closure strip 15 (FIGS. 16–19). Thereafter, the fingertips 160 are spread apart to grip the upper edges of the pouch 14 and open. the zipper lock 15 as the upper pouch edges 71 are pulled apart.

Generally, to lower and raise the fingertips 160 in the region of the base unit 69, each spreader assembly 75 includes a cam follower 161 which projects rearwardly therefrom as seen in FIG. 3B. The cam follower 161 rides along the track-like cam surfaces C as defined on the cam plates 141, support rail 137, transition blocks 146 and 147 and the lower support rail 154.

When the cam follower 161 reaches the declined transition block 146, the spreader assemblies 75 travels downwardly from the raised position to the lowered position for insertion of the fingertips 116 into the upper open end of the pouch 14. Thereafter, upon completion of the pouch-opening stage, the cam follower 161 rises through the inclined transition block 147 for removal of the fingertips 160 from the pouch 14.

To effect spreading of the fingertips 160, each spreader assembly 75 includes a lever arm 162 having a cam follower 163 on the outer end thereof (FIG. 3B). As illustrated on the front of the pouch-opening apparatus 12, the cam follower 163 contacts a frame-supported cam plate 166 which opens the fingertips 160, and thereafter, the cam follower 163 strikes a second downstream frame-supported cam plate 167 to close the fingertips 160.

Referring to FIGS. 6–9, the spreader assembly 75 includes a vertical backing plate 170, the upper and lower ends of which have support bars 171 and 172 bolted thereto. The leading end of each support bar 171 and 172 includes a vertical bore 173 having a square-shape, while the trailing end thereof includes a vertical bore 174 having an ellipse shape.

The bores 173 and 174 slidably receive the respective guide rods 120 and 121 vertically therethrough. Accordingly, the spreader assembly 75 is freely slidable along the vertical length of the rods 120 and 121. The different shapes of the bores 173 and 174 permits circumferential movement of the spreader assembly 75 about the drive disks 98.

To effect vertical movement, the cam follower 161 projects rearwardly from the backing plate 170, and includes a spacer 175, a rotatable roller 176 and a pin 177. As discussed previously herein, the cam follower 161 is able to travel along the annular track C while lowering and raising the spreader assembly 75 as the cam follower 161 rolls through the transition blocks 146 and 147.

To support the fingertips 160, the backing plate 170 further includes a housing 180 which is formed from a lower housing wall 181 and an upper housing wall 182. The upper and lower housing walls 181 and 182 include hollowed out recesses which define an interior cavity 183 in which a pair of separately rotatable gears 184 are seated.

Further, the upper housing wall 182 is formed with openings through the front and rear sides thereof which open into the interior cavity 183, while the backing plate 170 includes an opening 186 which opens into the back end of the interior cavity 183. Each of the fingertips 160 is slidable into and out of the interior cavity 183 to facilitate spreading of the fingertips 160.

More particularly, each of the fingertips 160 includes a horizontal drive member 188 which is slidably received in the interior cavity 183. The front ends of the drive members 188 project from the front of the interior cavity 183 while the rear ends thereof project rearwardly through the opening 186.

The inner face of each drive member 188 includes a gear rack 189 wherein the gear racks 189 are parallel to each other and cooperate with the gear teeth on the outer circumference of the gears 184. Since the gears 184 are independently movable, movement of one drive member 188 outwardly in the direction of reference arrow D in FIG. 11 effects an equal but opposite movement of the other drive member 188 rearwardly in the direction of reference arrow E.

The outer ends of the drive members 188 each include a fingertip member 191 which is fastened thereto by fasteners 192. The fingertip members 191 include a bracket section 193 which is generally L-shaped when viewed from above, and an end section 194 which is L-shaped when viewed from the side so as to project outwardly and downwardly therefrom. The bracket section 193 permits the drive members 188 to be horizontally offset relative to each other to accommodate the gears 84 therebetween.

With this arrangement, the fingertip end sections 194 are aligned in an overlying relation so that the end sections 194 move horizontally toward and away from each other in the same vertical plane. This vertical plane is oriented perpendicular to the pouch path 55.

Figure 7:
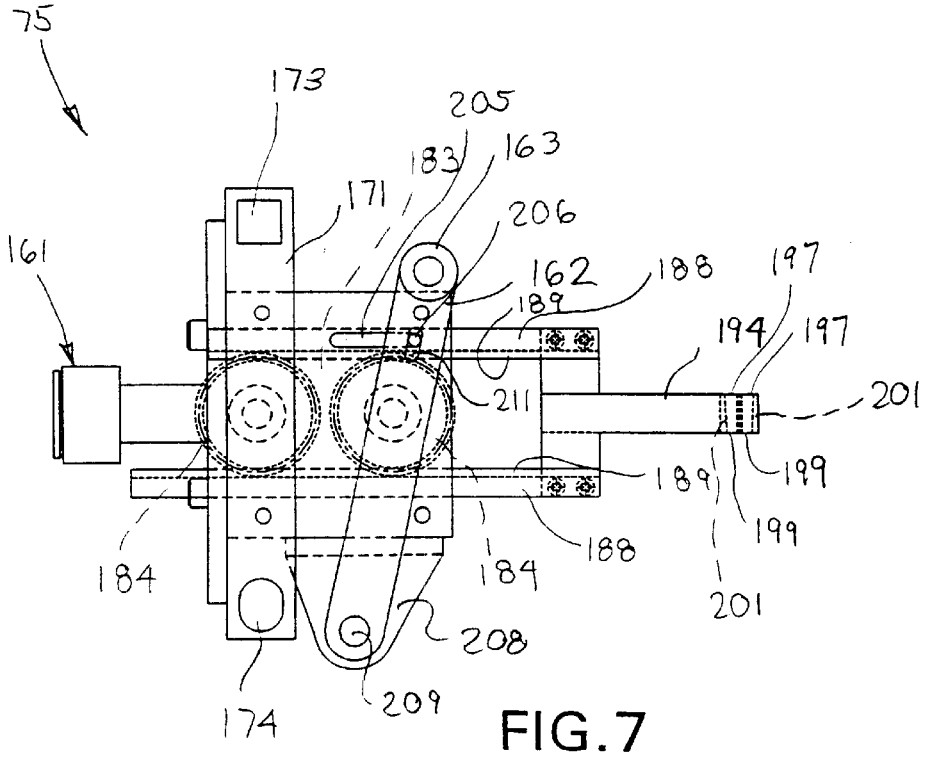
FIG. 7 is a plan view of the closed spreader assembly.
Figure 8:
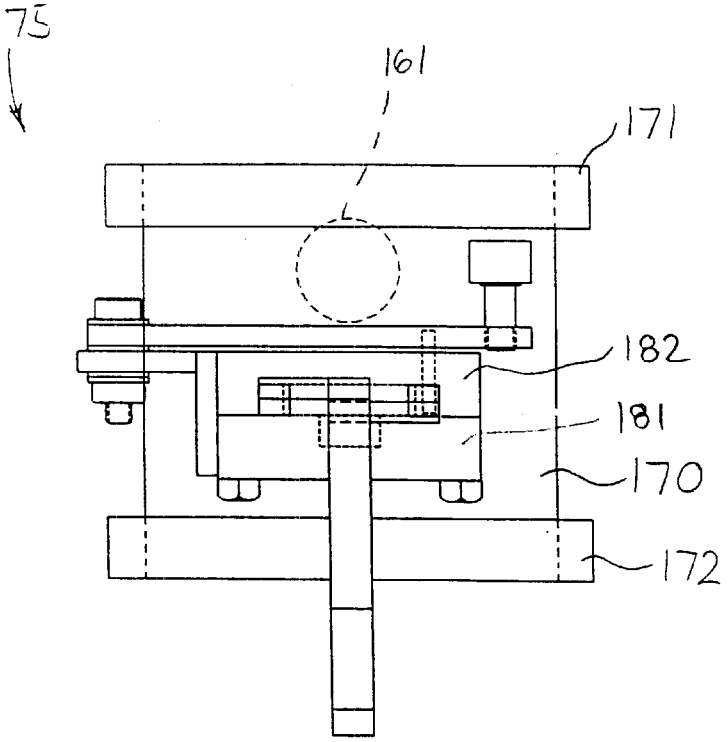
FIG. 8 is a front elevational view of the closed spreader assembly.
Figure 9:
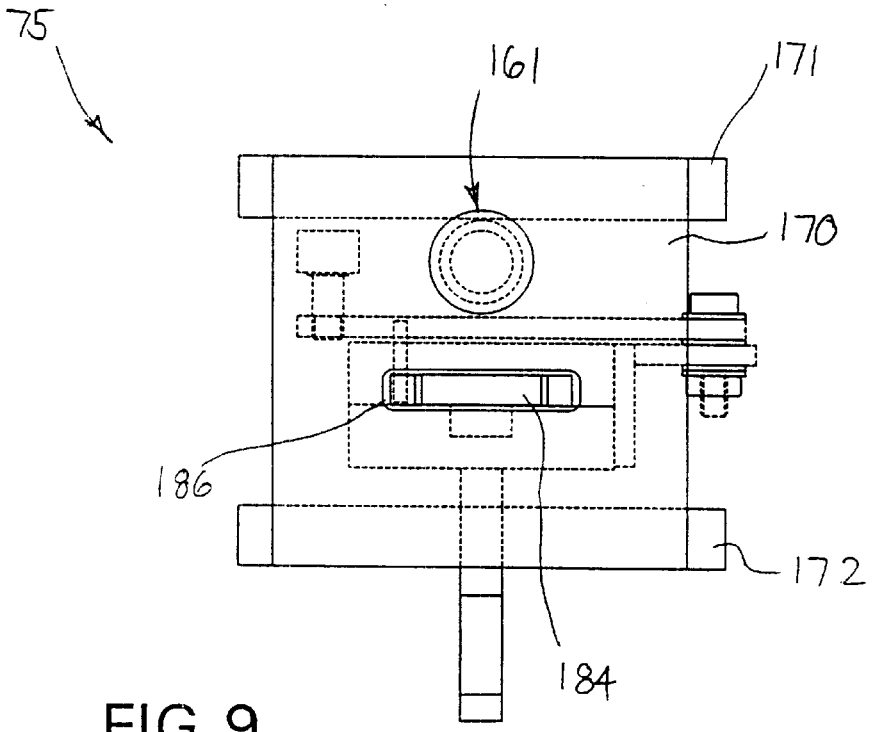
FIG. 9 is a rear elevational view of the closed spreader assembly.

The tip end 196 of each end section 194 has a reduced thickness which tapers downwardly to a point to facilitate insertion of the fingertips 160 downwardly into the pouch 14 in the first stage. Still further as seen in FIG. 7, the outward-facing jaw face 201 of each lower end 196 tapers from a wider leading edge 198 to a narrower trailing edge 199 which facilitates gripping of the pouch 14 as will be discussed herein. Each lower end 196 thereby defines an inner jaw of the pouch-opening apparatus 12 whereby the jaw face 201 faces outwardly for gripping contact with the pouch 14.

To open and close the fingertips 160, the drive members 188 are connected to the lever arm 162. In particular, an elongate slot 205 opens vertically through the upper housing wall 182. The elongate slot 205 is generally parallel and overlies an upper edge of one drive member 188. A pin 206 projects downwardly through the slot 205 into engagement with the drive member 188.

The upper end of the pin 206 engages the pivoting lever arm 162. More particularly, one end of the lever arm 162 is pivotally connected to a pivot flange 208 by a pivot pin 209 which pin 209 defines a vertical pivot axis about which the lever arm 162 rotates. The outer distal end of the lever arm 162 includes the cam follower 163 as previously discussed herein.

Figure 10:
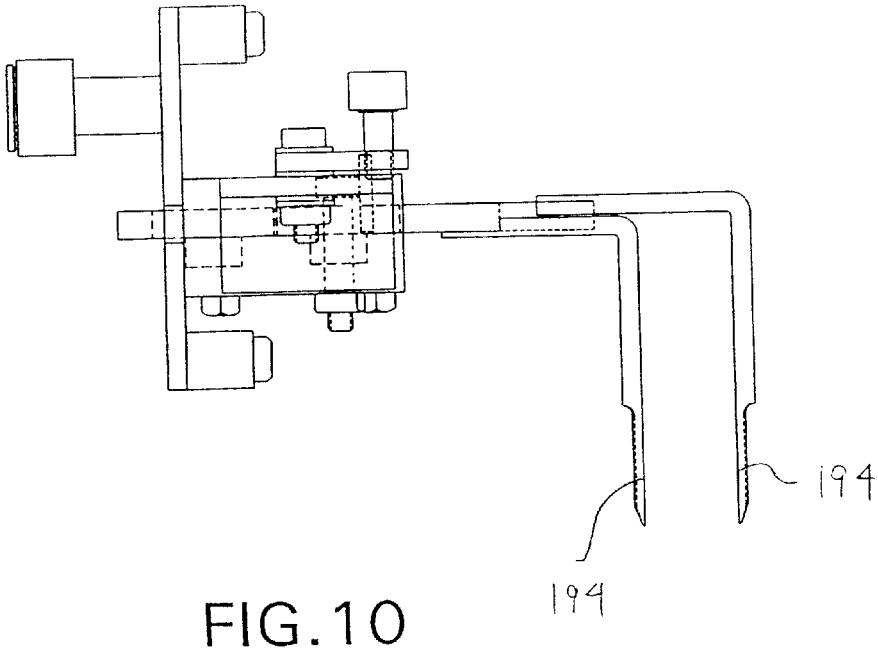
FIG. 10 is a side elevational view of the spreader assembly illustrating the fingertips in an open position.
Figure 11:
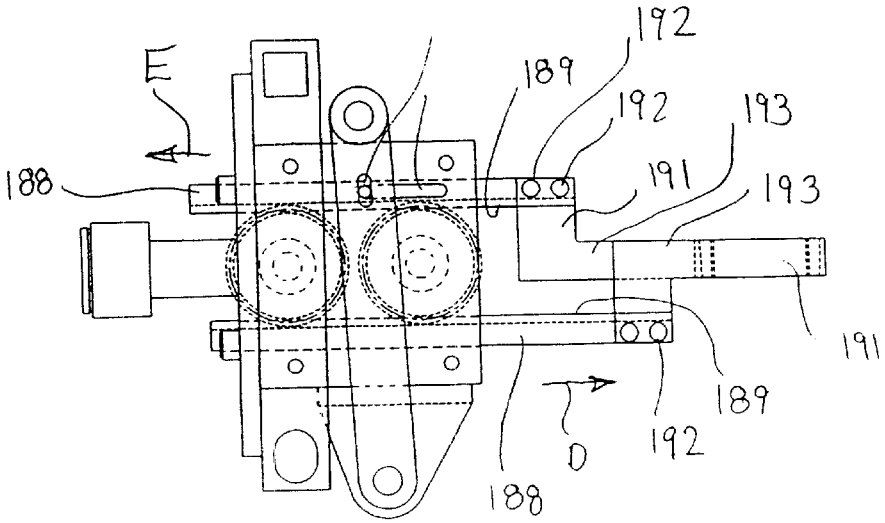
FIG. 11 is a plan view of the open spreader assembly.

The lever arm 162 further includes a slot 211 which slidably receives the connector pin 206 therethrough. Accordingly, upon pivoting of the lever arm 162 leftwardly in response to contact with the cam plate 166 (FIG. 3B), the connector pin 206 moves with the lever arm 162 and causes the corresponding drive member 188 to be moved leftwardly which in turn causes a corresponding rightward movement in the other drive member 188 as generally illustrated in FIGS. 10 and 11. This movement of the lever arm 162 causes the jaws 196 to be spread apart. A reverse pivoting movement of the lever arm 162 by the cam plate 167 reverses the movement of the jaws 196 to thereby close the fingertips 160.

As the fingertips 160 travel horizontally, particularly in the region of the base unit 12, the fingertips 160 are vertically aligned with a respective one of the carriers 40 and in particular, aligned with the upper edges of the pouch 14 supported by the respective carrier 40. This permits the fingertips 160 to be inserted downwardly into the upper end of the pouch 14 and then opened to spread the upper edges of the pouches 14 apart. The specific path along which the fingertips 160 move vertically is identified by reference line 214 in FIGS. 4 and 12.

As can be seen from the foregoing discussion, the carousel unit 70 provides for movement of the spreader assembly 75 not only horizontally but also vertically. As discussed hereinafter, each spreader assembly 75 thereby cooperates with the base unit 69 to effect opening of the pouches 14.

2. Base Unit

Turning to the base unit 69, the base unit 69 includes the vacuum assembly 72 which is connected to the outer jaw assembly 73. The vacuum assembly 72 defines the first stage wherein the upper flaps 71 of the pouch 14 are separated to permit on initial insertion of the fingertips 160 between the flaps 71, while the outer jaw assembly 73 cooperates with the spreader assembly 75 to grip and open the pouch 14. While the outer jaw assembly 73 and the vacuum assembly 72 perform separate functions and may be operated separately, these components of the invention preferably are serially connected together as described in further detail herein to ensure synchronized operation.

More particularly, the base unit 69 includes a base frame 220 which includes vertical support legs 221 that are fixedly connected to and project upwardly from the base pad 80 of the machine frame 41. At one end of the base frame 220, a vertically spaced apart pair of support brackets 222 projects horizontally from the rightward support leg 221 to support the outer jaw assembly 73.

The outer jaw assembly 73 and the vacuum assembly 72 are each formed of two horizontally elongate sections which diverge relative to each other. In particular, the vacuum assembly 72 and the outer jaw assembly 73 are each defined by a front half and a rear half which are formed as mirror images of each other. The front halves of the assemblies 72 and 73 are connected serially together and define one diverging section, while the rear halves define the other diverging section of the base unit 69.

First with respect to the front half of the outer jaw assembly 73, this front half is supported at its right end on the support brackets 222. The outer jaw assembly 73 further includes a first sprocket 224 which is rotatably supported at the upper and lower ends thereof by the support brackets 222.

A drive shaft 225 is connected at an upper end to the sprocket 224 and at an opposite end to a motor 226. The motor 226 is supported on the frame 220 by a motor bracket 228 wherein the motor 226 drives the sprocket 224.

The outer jaw assembly 73 further includes a support bar 230 which is rigidly connected at a right end to the support brackets 222 while the opposite end thereof projects outwardly therefrom in cantilevered relation. The outer cantilevered end is rigidly fastened to additional upper and lower support brackets 232.

The support brackets 232 also support a sprocket 233 which is rotatable about a vertical drive shaft 235. The inner and outer sprockets 224 and 233 are operatively connected together by an endless drive chain 236 which extends horizontally therebetween.

To grip the pouches 14 in cooperation with the spreader assembly 75, the drive chain 236 includes a plurality and preferably three gripping pads 237. The pads 237 are rigidly supported on and project outwardly from the chain 236 by pad brackets 237, and are spaced at substantially equal distances from each other. The pads 237 travel in a clockwise direction along an annular path identified in phantom outline by reference line 238.

As will be described herein, the pads 237 align with the fingertips 160 of a corresponding one of the spreader assemblies 75 as the pads 237 travel adjacent to the pouches 14. The pads 237 effectively define outer jaws which cooperate with the inner jaws 196 defined on the spreader assembly 75.

To drive the opposite rear half of the outer jaw assembly 73, the outer end of the outer jaw assembly 73 is first connected to and drives the vacuum assembly 72 which in turn is connected to and drives the rear half of the outer jaw assembly 73.

More particularly, the upper end of the drive shaft 235 projects upwardly above the support plates 232, the upper end of which includes a drive hub or drum 241. The drive hub 241 effects rotation of an identical driven hub 242 by an endless drive belt 243 which horizontally extends therebetween. The driven hub 242 is connected to and effects driven rotation of the vacuum assembly 72 as discussed hereinafter.

Further, the outer end of the outer jaw assembly 73 rigidly supports the adjacent end of the vacuum assembly 72 by a yoke-shaped support plate 240. Specifically, the right end of the plate 240 is rigidly connected to the support brackets 232 while the opposite left end of the plate 240 is connected to similar support plates 246 of the vacuum assembly 72.

The driven hub 242 of the vacuum assembly 72 is connected to and drives a drive shaft 247 which projects downwardly through the plate 246 and drives a lower hub 248 which hub 248 is supported on the support plates 246. This hub 248 has a cylindrical outer surface and drives a relatively thick elastomeric vacuum belt 249.

The vacuum assembly 72 further includes a rigid vacuum bar 250 which is horizontally elongate and is supported at its outer end by the support plates 246. Its inner end is supported by additional support plates 252 which are cantilevered from and project horizontally outwardly from the left support post 221 of the support frame 220.

The support plates 252 further support an inner hub 254 which is drivingly connected to the elastomeric belt 249. The inner hub 254 is connected to a drive shaft 255 which projects upwardly above the support plates 252 and supports a gear 257.

Accordingly, when the motor 226 is operated, the interconnected sprockets 224 and 233 and chain 236 rotate to cause the pads 237 to rotate in the clockwise direction. The outer sprocket 233 further drives the drive hub 241 which in turn drives the drive hub 242 through the belt 243 which is connected therebetween.

As a result, the vacuum belt 249 on the front half travels in a clockwise direction, and effects rotation of the gear 257 which is located on top of the support plates 252. As can be seen, these front halves are driven serially together and define the front section of the base unit 69.

The opposite rear section of the entire pouch-opening apparatus 12 is formed substantially identical to the above-described components of the outer jaw assembly 73 and vacuum assembly 72. Accordingly, the meshed gears 257 at the downstream end of the pouch-opening apparatus 12 are in meshing engagement such that clockwise rotation of the gear 257 on the front section effects a corresponding but opposite counterclockwise rotation of the gear 257 on the opposite rear section. This thereby causes the remaining components on the rear section, namely the rear vacuum belt 249 and the rear chain 236 to be driven synchronously with corresponding components on the front section. Thus, while the front and rear sections of the pouch-opening apparatus 12 diverge relative to each other so as to define an inner space 260 therebetween, both sections are serially connected together such that only one drive motor, namely drive motor 226 is provided.

More particularly with respect to the outer jaw assembly 73, each pair of fingertips 160 thereby aligns with a corresponding pair of front and rear outer jaw pads 237 which move in unison therewith. Since the opposing front and rear pads 237 travel along diverging paths, the fingertips 160 can be spread apart while maintaining constant gripping contact with the pads 237 aligned therewith as generally illustrated on the right end of FIG. 13.

As seen in FIG. 13, the fingertips 160 are in the closed position as they move downwardly and are inserted between the upper flaps 71 of the pouches 14 in the first stage. As the spreader assembly 75 and the associated fingertips 160 continue to travel rightwardly, the pair of the aligned pads 237 turn the corner of the outer sprockets 233 in the second stage and are aligned directly in opposing relation with the fingertips 160 with the pouch flaps 701 being pressed therebetween. As the pads 237 and fingertips 160 continue traveling rightwardly, the pads 237 diverge away from each other. However, a corresponding spreading movement of the fingertips 160 is effected by the cam follower 163 which causes the upper flaps 71 to continue to be gripped therebetween. This spreading movement of the fingertips 160 thereby overcomes the engagement force of the zipper lock 15 and pulls the upper flaps 71 apart which effects separation of the mating strips 15*a* and 15*b*.

At the outlet end of the pouch-opening apparatus 12, an additional blow nozzle 262 may be provided which directs a jet of air downwardly to inflate i.e. open the pouch 14 for later filling.

With this arrangement, the pouches 14 may be readily opened. However, to further assist in the opening of the pouches 14 and in particular, in the insertion of the fingertips 160 between the closure strips 15, the vacuum assembly 72 also operates in combination with the outer jaw assembly 73.

More particularly, the vacuum assembly 72 is provided to pull the flaps 71 apart to expose the upper edges of the closure strips 15. This initial vacuum stage, however, is insufficient to actually separate or disengage the zipper lock 15.

Figure 14:
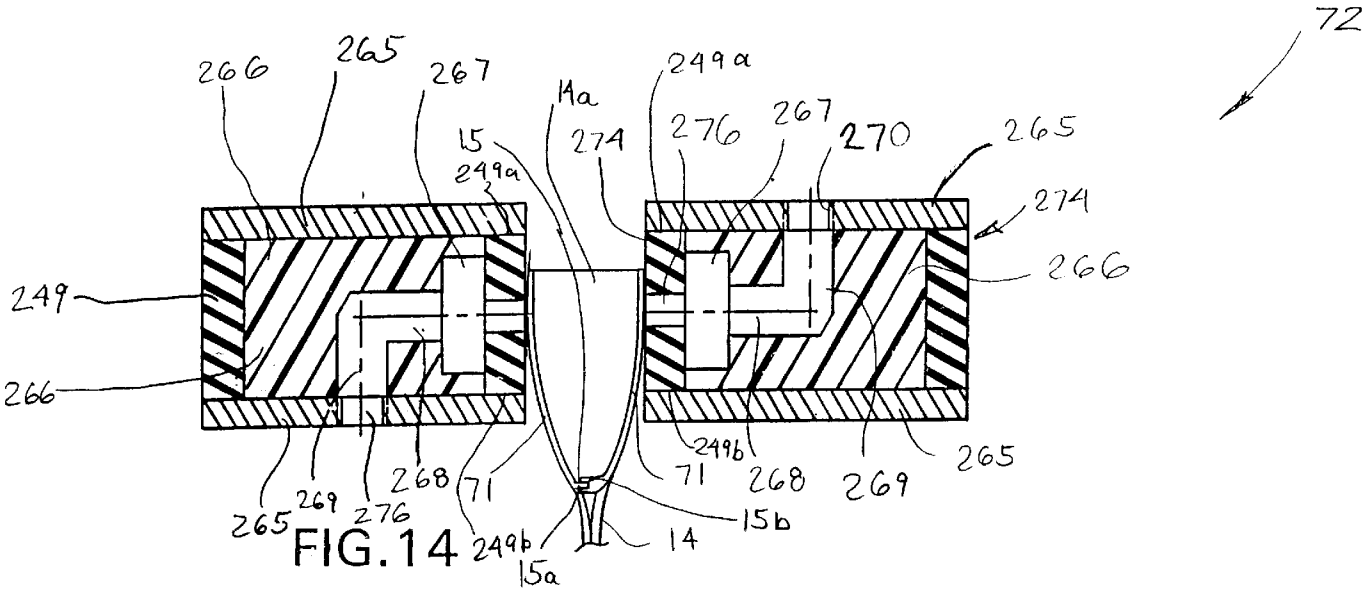
FIG. 14 is a diagrammatic end view in cross-section of a first stage of the base unit as taken along line 14—14 of FIG. 13.
Figure 15:
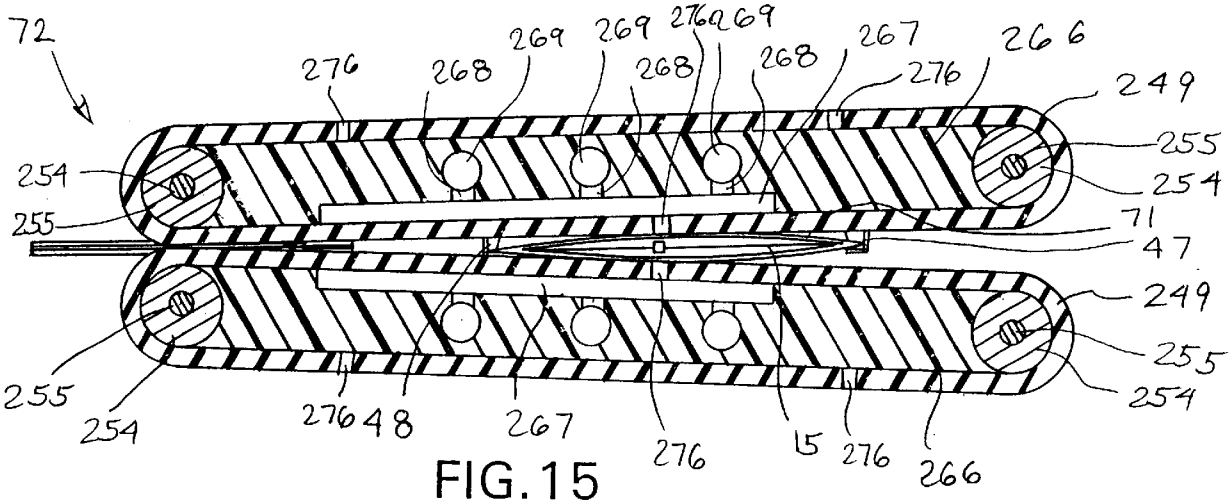
FIG. 15 is a diagrammatic plan view in cross-section of the first stage of the base unit as taken along line 15—15 of FIG. 12.

Referring to FIGS. 14 and 15, to form the vacuum, the vacuum bar 250 includes rigid upper and lower plates 265 which are connected to a rigid plastic block 266 disposed vertically therebetween. The plastic block is formed with a horizontally elongate vacuum chamber 267 formed on the inner side thereof. The vacuum chamber 267 is in communication with three horizontal passages 268, which passages 268 in turn communicate with vertical bores 269.

The bores 269 open vertically through the plate 265 through connector ports 270. The vacuum ports 270 preferably have a hose fitting 272 (FIG. 13) connected thereto for ready connection to vacuum hoses. When a vacuum is applied to the vacuum ports 270, a corresponding vacuum is thereby formed in the vacuum chamber 267.

The vacuum chamber 267 is sealed from the exterior environment by the drive belt 249. In particular, the top and bottom plates 265 project outwardly of the inner plastic block 266 to define elongate recesses 274 in which the belt 249 is slidably fitted. Since the belt 249 is relatively thick and fits snugly into the recesses 274, the belt 249 effectively seals the vacuum chamber 267 from the exterior environment along its upper and lower circumferential edges 249*a* and 249*b* (FIG. 14).

However, the belt 249 is provided with a plurality and preferably three vacuum passages or ports 276 which open horizontally therethrough. The vacuum passages 276 are spaced equidistantly apart, similar to the pads 237, and align with the fingertips 160 as the fingertips 160 pass between the front and rear vacuum bars to 50.

The vacuum passages 276 serve to pull and spread the upper flaps 71 of the pouch 14 away from each other which thereby exposes the upper edges of the closure strips 15. This facilitates insertion of the fingertips 160 downwardly between the flaps 71.

Since the front and rear halves of the vacuum assembly 72 are driven simultaneously by the gears 257, the belts 249 and particularly, the vacuum passages 276 on the front half move clockwise, while the vacuum passages 276 on the rear half move counterclockwise. Despite the opposite rotational directions, opposing pairs of front and rear vacuum passages 276 face toward the pouch path 55 and move simultaneously together.

The front and rear halves diverge relative to each other so that the opposing belts 249 are disposed at increasing but equal distances from the pouch path 55. This diverging movement of the belts 249 provides increasing space therebetween to permit the fingertips 160 to be inserted downwardly therebetween.

Alternatively, the vacuum assembly may include a pair of movable suction cups. These suction cups move longitudinally along the pouch path and sidewardly away from the pouch path to pull and spread the upper flaps 71 away from each other.

The pads 237 move in the same manner as the belts 249. In particular, the pads 237 on the front half move clockwise, while the pads 237 and the rear half move counterclockwise. The front and rear halves also diverge although the divergence angle defined therebetween for the outer jaw assembly 73 is greater than the divergence angle of the vacuum assembly 72. This greater divergence angle allows greater separation of the pouch flaps 71 for the same horizontal travel.

To permit adjustment of the divergence angles, the various support plates 222, 240, 252 are provided with elongate bolt holes which permits adjustment of the relative angles therebetween.

In view of the foregoing, the pouch-opening apparatus 12 of the invention includes the base unit 69 and the carousel unit 70, which components cooperate as follows to open the pouches 14.

Referring to FIGS. 16–19, the pouch flaps 71 are first separated from each other by the alignment of the vacuum passages 276 of the front and rear belts 249 with the respective front and rear flaps 71. This generates a pulling force on the flaps 71 which allows the fingertips 160 to be inserted downwardly therebetween.

Figure 12:
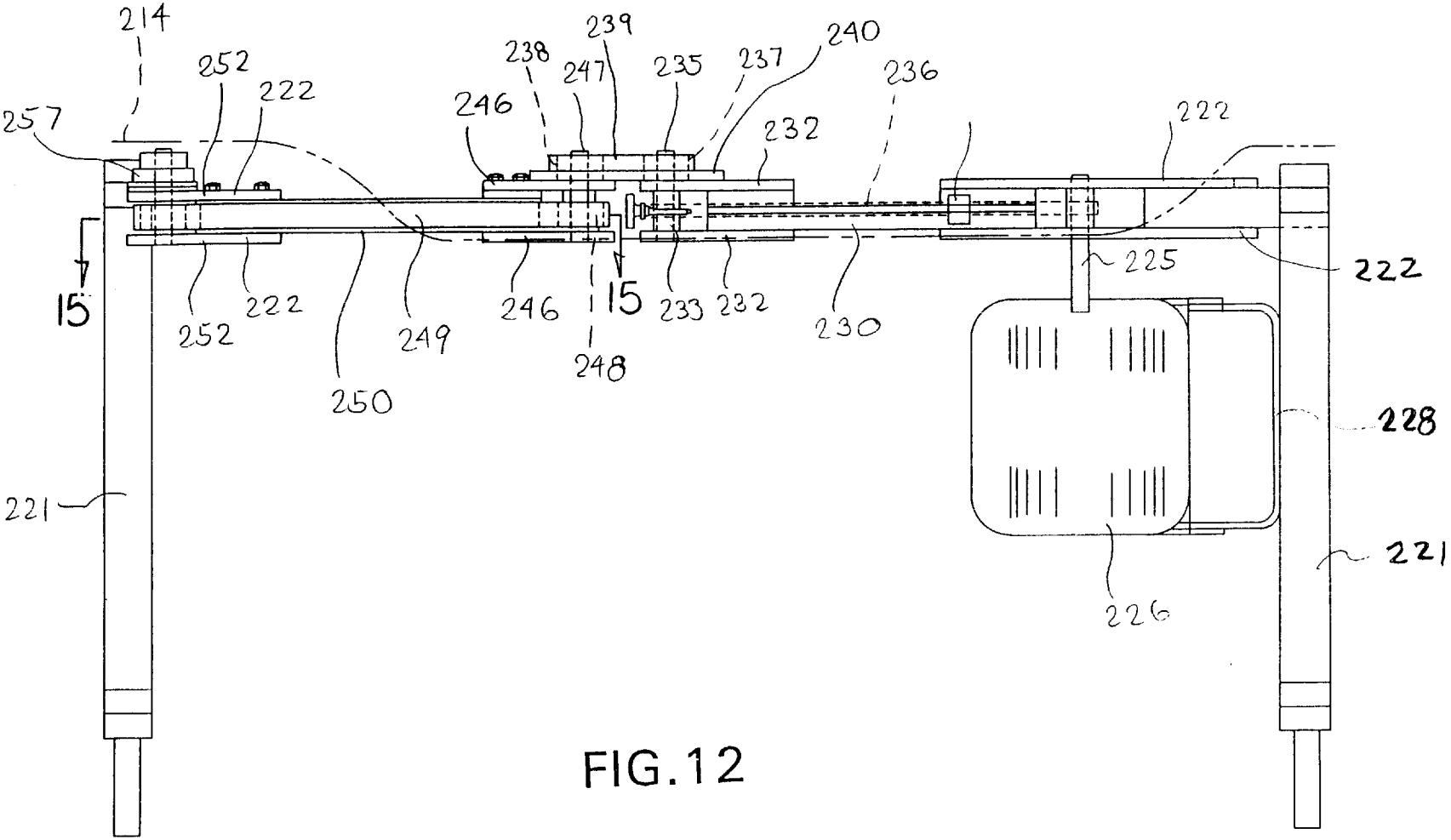
FIG. 12 is a front elevational view of a base unit of the pouch-opening apparatus which cooperates with the spreader assemblies for opening pouches.
Figure 17:
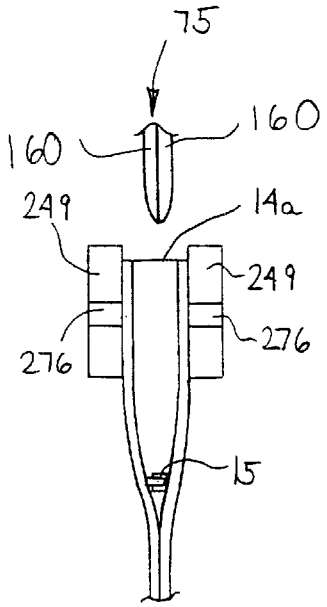
FIG. 17 is a diagrammatic end view of the first stage of the feed assembly after the flanges are separated but before the fingertips are inserted into the pouch.
Figure 18:
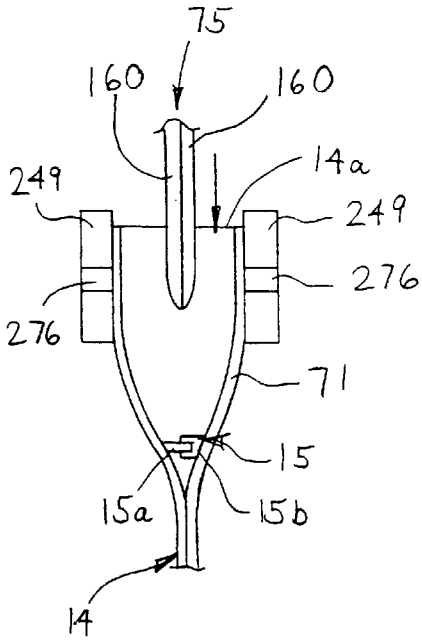
FIG. 18 is a diagrammatic end view of the first stage after the fingertips have been inserted between the upper flanges of the pouch.

This downward insertion of the fingertips 160 occurs as the cam follower 161 on the spreader assembly 75 travels down the declined transition block 146. Upon full insertion of the fingertips 160 as seen in FIG. 17, the upper flaps 71 are still being held apart by the vacuum passages 276. Reference line 214 of FIG. 12 illustrates the point at which the fingertips 160 are fully inserted between the flaps 71, just above the mating strips 15*a* and 15*b* of the zipper lock 15.

However, the fingertips 160 and pouch 14 continue to move continuously horizontally along the base unit 69. After the fingertips 160 are fully inserted, the vacuum provided by the vacuum assembly 72 no longer is required. Rather, the pouch 14 and fingertips 160 thereby pass into the second stage of the pouch-opening apparatus 12.

In this second stage, a pair of front and rear pads 237 define opposing outer jaws which turn the corner of the outer sprockets 233. These pads 237 align with and press inwardly against the outer faces 201 of the fingertips 160 such that the flaps 71 are gripped therebetween. As the spreader assembly 75 continues to move downstream, the cam follower 163 contacts the cam plate 166 to initiate opening of the fingertips 160. This opening of the fingertips 160 is at the same rate as the diverging movement of the pads 237 such that the flaps 71 remain gripped therebetween.

Figure 19:
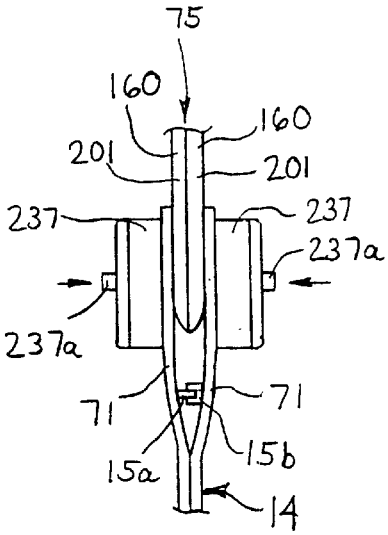
FIG. 19 is a diagrammatic end view of a second stage of the feed assembly as the fingertips grip the top edges of the pouch.
Figure 20:
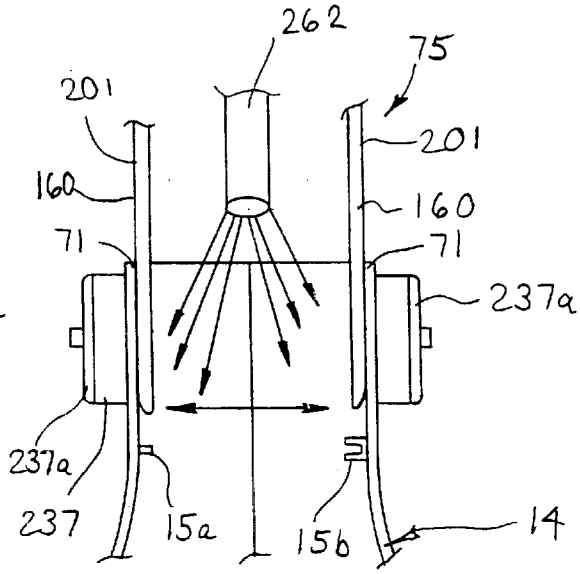
FIG. 20 is a diagrammatic end view of the second stage as the fingertips pull the pouch edges apart.

As the pouch 14 nears the end of the second stage, the fingertips 160 and the pads 237 reach their maximum separation at which point the mating closure strips 15*a* and 15*b* are fully separated as illustrated in FIG. 19. While separation of the flaps 71 reduces the distance between the opposite side edges of the pouch 14, the individual arms 47 and 48 of the carrier 40 move toward each other as generally illustrated in FIG. 13. Accordingly, when the pads 237 again turn the corner at the inner sprockets 224, the carrier 40 itself maintains the pouch 14 in the open position of FIG. 19.

To ensure complete opening of the bottom part of the pouch 14, the blower nozzle 262 provides a blast of air into the pouch 14. Once the pouch 14 is fully opened, the cam follower 163 strikes the cam plate 167 to initiate a closing of the fingertips 160. Further, the additional cam follower 161 also travels upwardly along the inclined transition block 147 to begin raising the fingertips 160 as indicated by reference line 214 in FIG. 12.

With these components, the pouches 14 can be continuously opened and then maintained in the open position by the carrier 40. The carriers 40 then transfer the opened pouches 14 to the pouch-filling apparatus 19 as discussed previously.

FEED TABLE/PICK AND PLACE MACHINE/ TRANSFER CONVEYOR

Referring to FIGS. 21–30, the following discussion relates to the initial transfer apparatus 16 discussed generally above and more particularly, to the feed table 22, the pick and place machine 31 and the transfer conveyor 28. These components cooperate functionally to continuously supply the pouches 14 one after the other to the feed roller unit 35 of the initial transfer apparatus 16, which pouches 14 then are transferred to the carrier apparatus 17.

Figure 29:
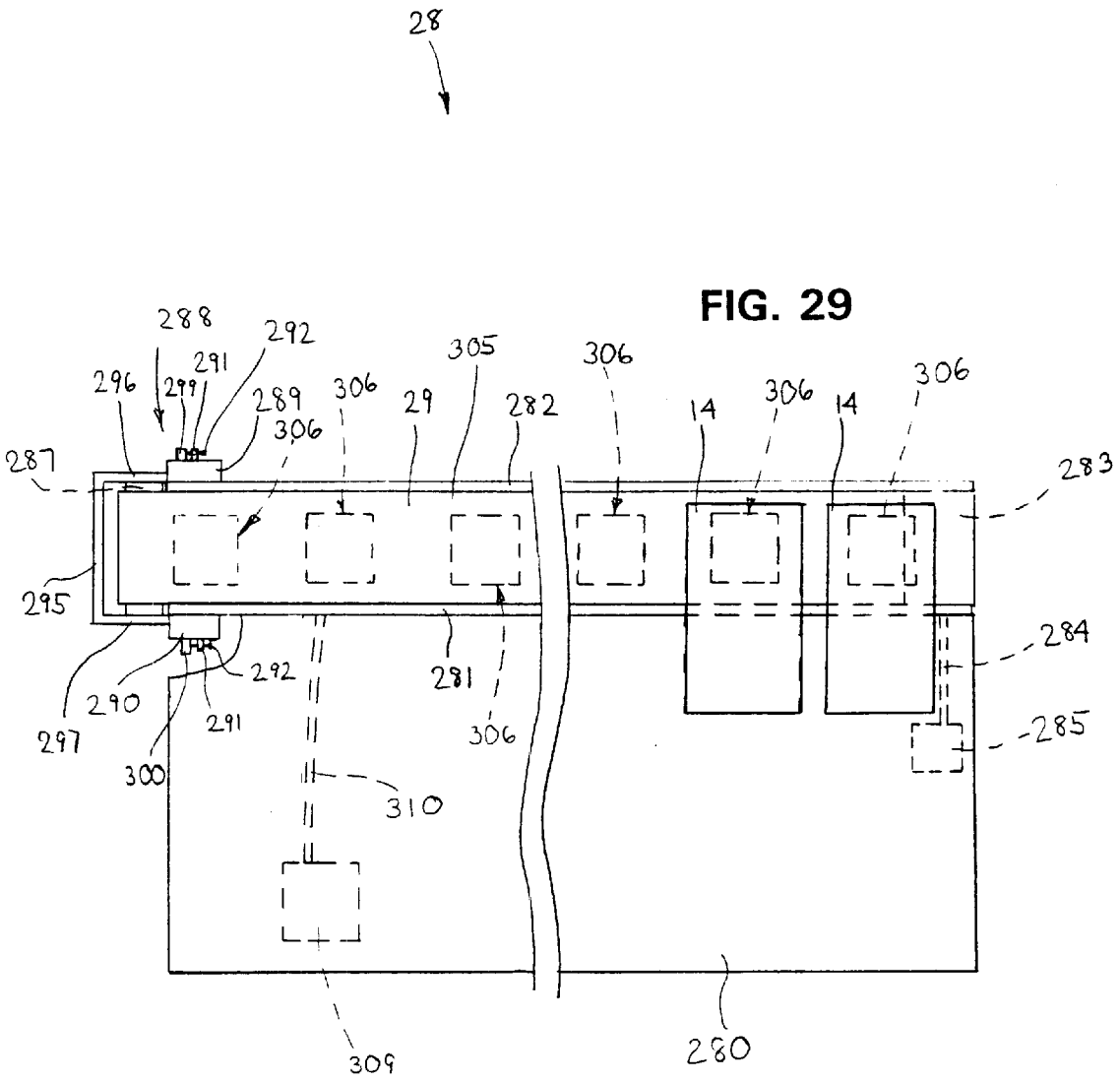
FIG. 29 is a broken end elevational view illustrating the transfer conveyor belt unit.

More particularly as to the transfer conveyor 28, the transfer conveyor 28 includes the sideward-facing conveyor belt 29 which is adapted to hold the pouches 14 vertically thereon through the application of a vacuum to the pouches 14. Referring to FIG. 29, the transfer conveyor 28 includes a conveyor housing 280 which is supported on a floor upstream of the carrier apparatus 17. On the top of the carrier housing, the conveyor belt 29 is supported.

Figure 21:
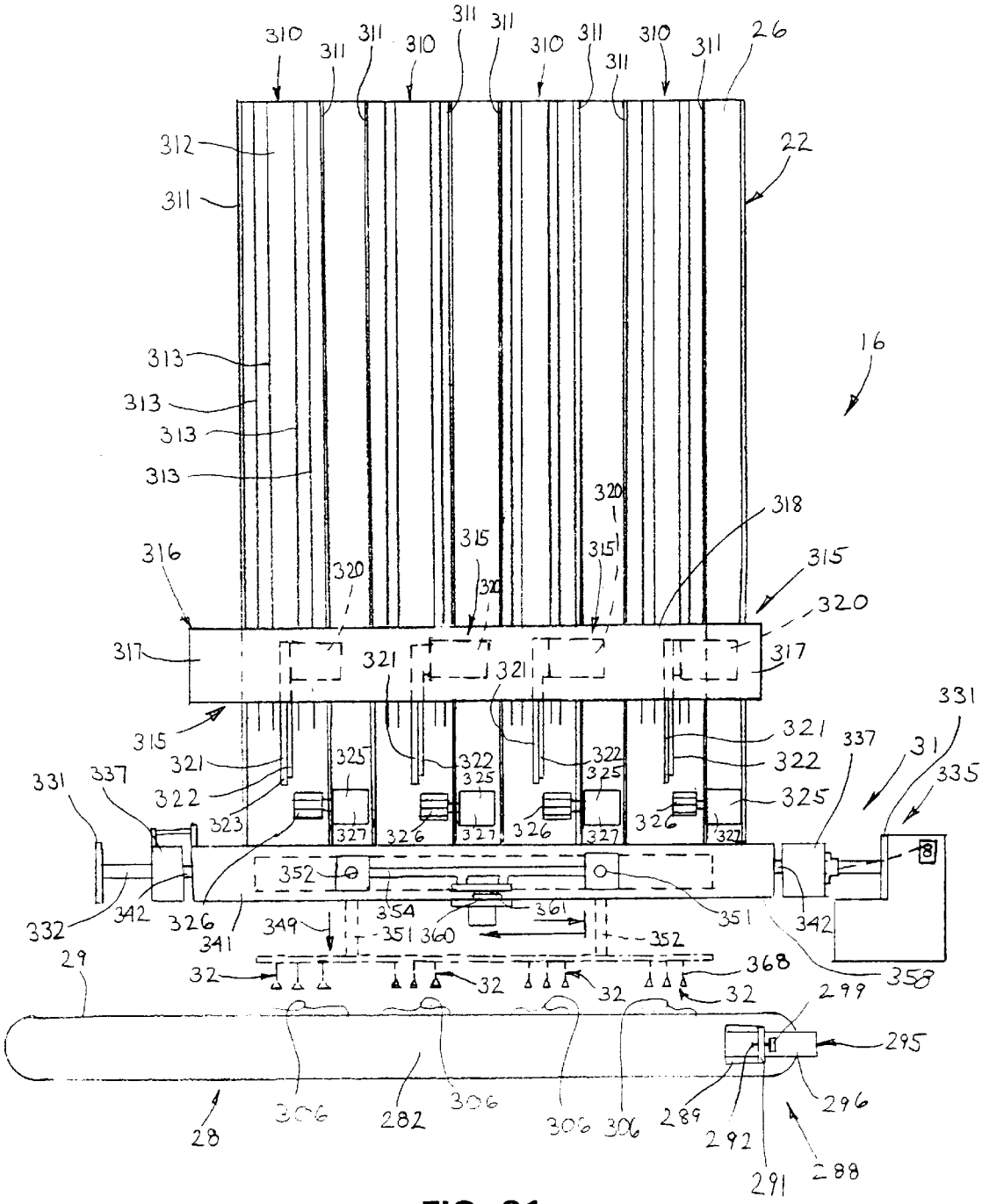
FIG. 21 is a plan view of an initial transfer apparatus including a transfer conveyor, a pick and place machine and a transfer table.
Figure 24:
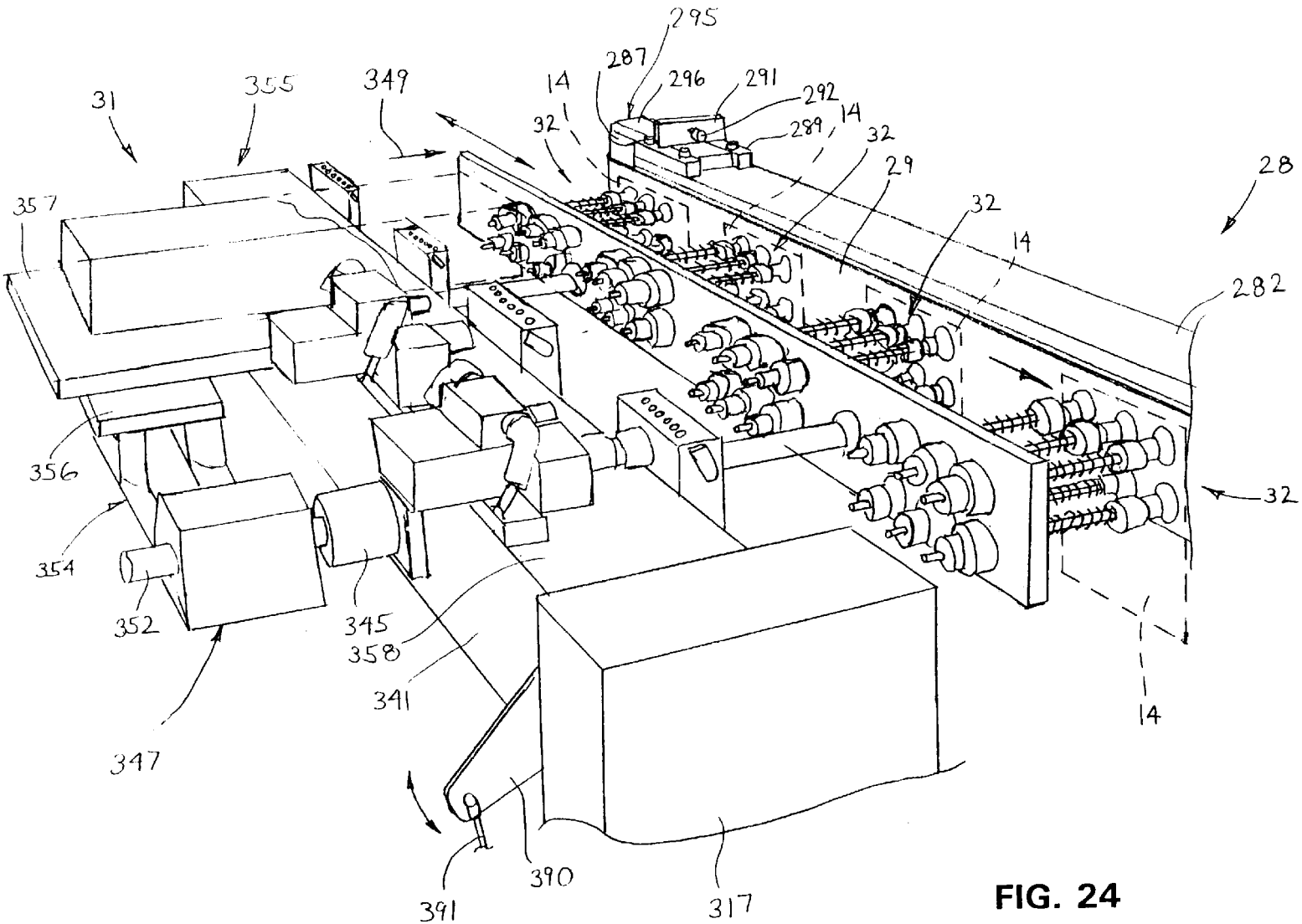
FIG. 24 is a top perspective view of the pick and place machine and the transfer conveyor.

Specifically as to FIGS. 21, 24 and 29, the transfer conveyor 28 includes a pair of vertically spaced apart, horizontally elongate support plates 281 and 282. The downstream ends of the support plates 281 and 282 support a rotatable drum 283 which drum 283 is rotatable about a vertical rotation axis. The drum 283 is drivingly connected to a vertical drive shaft 284 which is driven by a drive motor 285 (FIG. 29). The drive motor 285 runs continuously during the packaging operation.

The upstream ends of the plates 281 and 282 rotatably support a driven second roller 287. The driven roller 287 is supported by a tension adjustment mechanism 288 which mechanism 288 is supported on the plates 281 and 282. The tension adjustment mechanism includes slotted support blocks 289 and 290 which are disposed on the upper and lower plates 282 and 281 respectively. The upper support block 289 includes an upstanding plate 291 which has an adjustment screw 292 projecting horizontally therethrough. A similar arrangement of a support plate 291 and an adjustment screw 292 are also provided on the lower support block 290 (FIG. 29).

The tension adjustment mechanism 288 further includes a U-shaped support bracket 295 which rotatably supports the driven roller 287 by upper and lower legs 296 and 297 thereof. The free ends of the upper and lower legs 296 and 297 are slidably received in the respective support blocks 289 and 290 so that the driven roller 287 can be moved horizontally to tighten the tension on the conveyor belt 29. The upper and lower bracket legs 296 and 297 respectively include vertically projecting abutment plates 299 and 300 which are movable horizontally during sliding of the bracket legs 296 and 297 within the support blocks 289 and 290. To adjust the tension, the adjustment screws 292 are screwed sidewardly to press against the respective abutment plates 299 and 300 and thereby drive the support bracket 295 sidewardly for adjusting the belt tension 29.

Referring to the conveyor belt 29, the belt is adapted to hold the individual pouches on the vertical exterior surface 305 of the belt. In this regard, the belt 305 is provided with a plurality of horizontally spaced apart groupings 306 (FIG. 29) of vacuum holes. The vacuum holes are provided in a 4×9 pattern of four rows and nine columns of holes which open sidewardly through the belt 29. Each 4×9 grouping of vacuum holes is identified diagrammatically by reference numeral 306 in FIG. 29 wherein the two downstream end groupings 306 are illustrated as supporting pouches 14 in a vertical orientation.

To apply the suction or vacuum airflow through the individual holes of each grouping 306, the conveyor belt 28 is formed similar to the vacuum assembly 72 which vacuum assembly 72 has a conveyor-like belt thereon. As to the transfer conveyor 28, an arrangement of internal passages are provided between the upper and lower plates 282 and 281 which passages are located rearwardly adjacent to the back face of the conveyor belt 29. The interior passages are connected to a vacuum pump 309 by an intermediate vacuum hose 310. As a result, the vacuum pump 309 applies a suction or vacuum airflow through the hose 310 to the interior passages which thereby creates a suction through the groupings 306 of openings as the openings pass along the front side (FIG. 29) of the conveyor belt 29. This allows the pouches 14 to be held on the belt 29 in a vertical orientation and then transferred downstream to the feed roller unit 35 in a continuous flow.

To supply the pouches 14 to the transfer conveyor 28 in a continuous uninterrupted manner, the feed table 22 and pick and place machine 31 are provided on the front side of the transfer conveyor 28. Referring to FIG. 21, the feed table 22 is positioned sidewardly adjacent to the transfer conveyor 28 in order to supply the pouches 14 to the pick and place machine 31 which thereby repositions the pouches on the transfer conveyor 28. Generally, the feed table 22 includes four feed chutes 310 which are arranged parallel to each other and extend longitudinally toward the transfer conveyor 28. Each feed chute 310 includes a row of the pouches 14 therein and moves the pouches 14 sequentially one after the other so that the pouches 14 can be grabbed and removed by the pick and place machine 31.

More particularly, each of the feed chutes 310 is delimited by upstanding side walls 311 wherein each pair of side walls 311 for an individual feed chute 310 are sidewardly spaced apart a distance which is approximate the lateral width of a pouch. Each feed chute 310 includes a bottom surface 312 and four parallel drive belts 313 which project upwardly through the bottom surface 312 to move the pouches 14 longitudinally along the feed chute 310.

Figure 25:
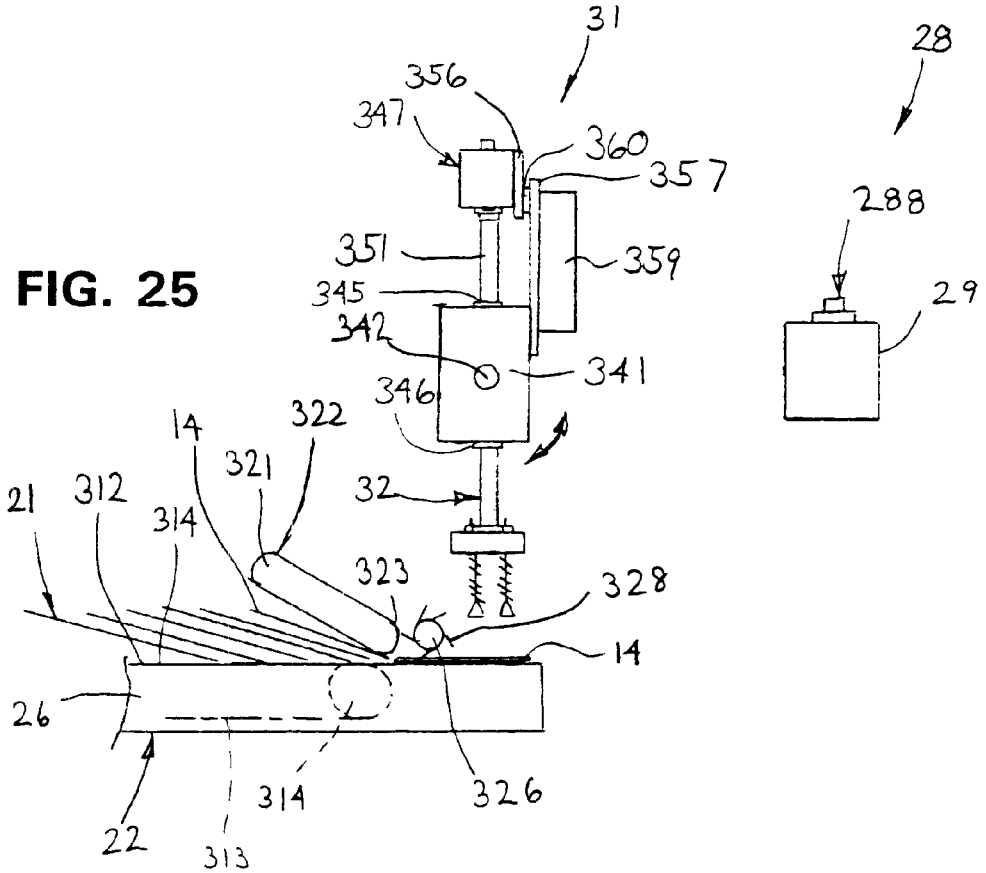
FIG. 25 is a diagrammatic side view illustrating the initial transfer apparatus with the pick and place machine in a pick position.

More particularly, the feed belts 313 are relatively narrow and arranged in parallel relation with each other wherein the upper surface of the feed belts 13 projects a slight distance through the bottom chute surface 312 so as to be in contact with the pouches 14. Referring to FIG. 25, the front end of each feed belt wraps downwardly around a guide roller 314 and is driven by a motor so that the stock 21 of pouches 14 have their lower edge portions in contact with the upper surface 314 of the feed belt 313 and are moved forwardly toward the end of the feed table 22. The feed belts 313 move continuously during operation to maintain a continuous pushing force on the pouches 14.

Referring to FIGS. 21 and 25, the feed table also includes a front feed unit 315 at the front end of each feed chute 310. The front feed units 315 are adapted to grab and pull the pouches 314 one at a time and move each individual pouch 14 to a flat final position illustrated in FIG. 25 for removal by the pick and place machine 31.

More particularly, the feed table 22 includes an upper support frame 316 (FIG. 21) which comprises opposite end posts 317 which extend vertically above the feed chutes 310 and support a cross beam 318 in an elevated position spaced above the feed chutes 310. The cross beam 318 supports the feed units 315 which are suspended from a bottom of the cross beam 318 and project downwardly towards the bottom surface 312 of the each chute 310.

Each feed unit 315 includes an electric motor 320 which is fixed to the bottom of the support beam 318 and a rigid support plate 321 which has an upper end rigidly connected to the support beam 318 and a lower end which angles downwardly and is suspended just above the chute surface 312 in cantilevered relation with the support beam 318. The support bar 321 rotatably supports a final feed belt 322 which feed belt 322 has an upper end section 323 that is rotatably driven by the respective motor 320. As seen in FIG. 25, the lower end 323 is disposed just above the chute surface 312 and is adapted to grip the lowermost edge of the leading pouch 14 of the stock 21 to thereby pull the leading pouch 14 from the stock 21 separately from the remainder of the pouches 14.

Lastly, the feed table includes a paddle unit 325 at the exit end of each feed chute 310. The paddle units 325 each include a feed paddle 326 which is driven by a motor 327. The feed paddle 326 includes a plurality of circumferentially spaced apart fingers 328 (FIG. 25) which contact the chute surface 312 and thereby during rotation of the feed paddle 325, the leading pouch 14 is taken from the final feed belt 321 and pulled to a horizontal flat position near the edge of the feed chute 310 as illustrated in FIG. 25. The feed paddle 326 operates intermittently after each set of pouches 14 are removed by the pick and place machine 31. Accordingly, after removal of each set of four pouches by the pick and place machine 31, the feed paddles 326 operate in unison to pull the next successive set of four pouches 14 from the stocks 21 and position these pouches 14 for removal by the pick and place machine 31.

Figure 22:
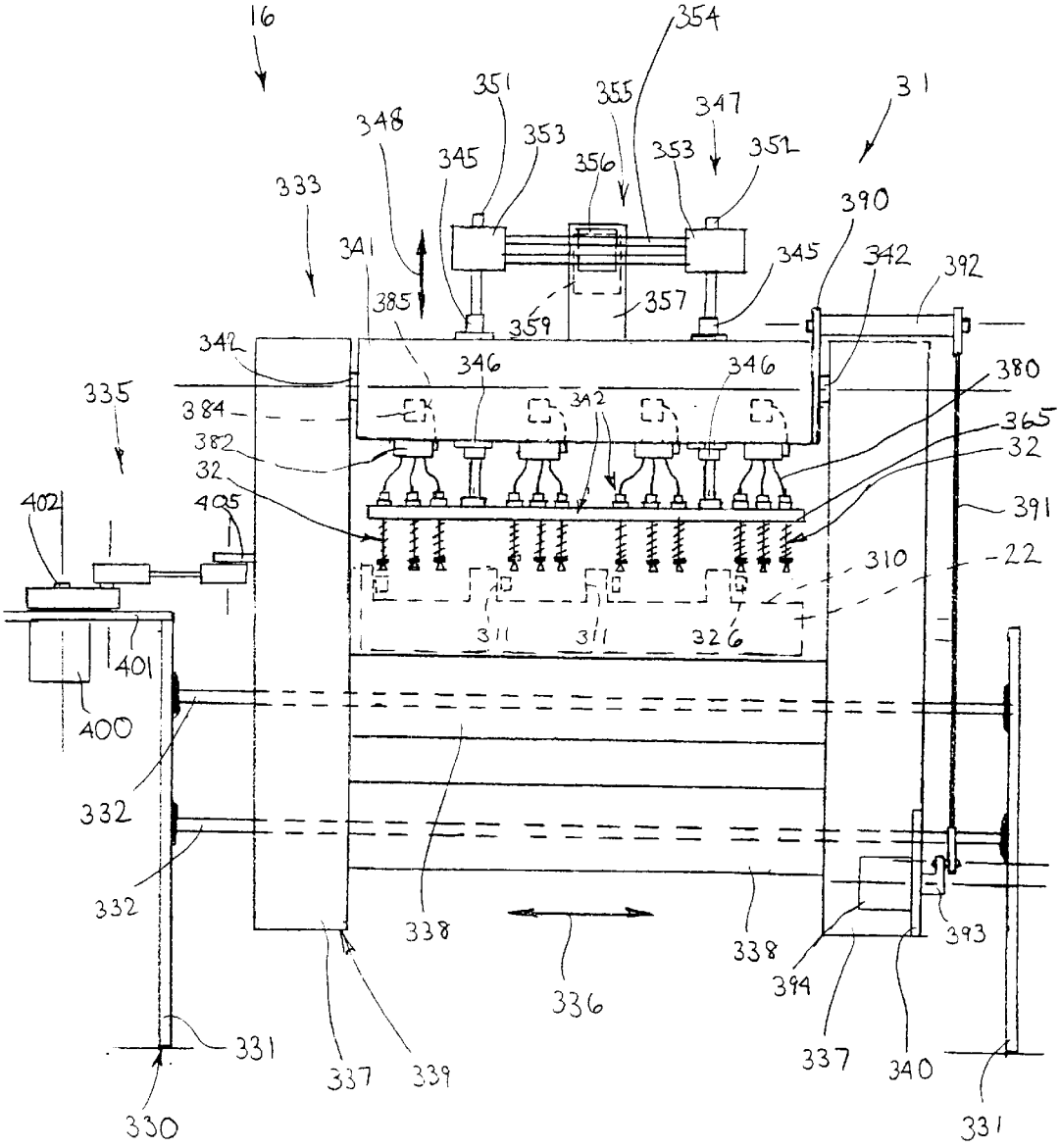
FIG. 22 is an end elevational view of the pick and place machine with the transfer table illustrated in phantom outline.

Referring to FIGS. 21 and 22, the pick and place machine 31 includes four pick and place units 32 which rotate 90 degrees between a pick position (FIG. 23) wherein the pouches 14 are removed from the feed bed 22 and a place position (FIG. 24) wherein the pouches 14 are placed onto the transfer conveyor 28.

More particularly, the pick and place machine 31 includes a base frame 330 (FIGS. 21 and 22) defined by upstanding support plates 331 which support plates 331 are laterally spaced apart and support a pair of vertically spaced horizontal guide rods 332. The guide rods 332 slidably support a carriage 333 thereon. The carriage 333 supports the pick and place units 32 and is sidewardly movable or translatable so that the pick and place units 32 can be moved sidewardly in unison with the conveyor belt 29 when placing the pouches 14 thereon. A drive unit 335 is connected between the carriage 333 and the support frame 330 to effect translational movement of the carriage 333 generally in the direction of reference arrow 336 (FIG. 22).

The carriage 333 includes a pair of vertical beams 337 which are joined sidewardly together by a pair of horizontal beams 338. The vertical beams 337 and the horizontal beams 338 are joined rigidly together and slidably receive the support tubes 332 horizontally therethrough to permit horizontal sliding of the carriage 333. The vertical beams 337 and the horizontal beams 338 thereby define a carriage frame 339. The carriage frame also includes a motor mount 340 which is discussed in further detail hereinafter.

The upper ends of the vertical rails 337 rotatably support a carriage support rail 341 which has the opposite ends thereof pivotally connected to the vertical support beams 337 by pivot bearings 342.

The support rail 341 further includes vertically aligned pairs of upper and lower bushings 345 and 346 which support a vertically movable slide assembly 347. The slide assembly 347 supports the pick and place units 32 thereon wherein sliding movement of the slide assembly 347 generally in the direction of reference arrow 348 (FIG. 22) allows the pick and place units 32 to be moved downwardly for picking of the pouches 14 from the feed table 22 and also horizontally and in direction of reference arrow 349 (FIG. 21) for placing of the pouches 14 onto the transfer conveyor 28.

The slide assembly comprises guide rods 351 and 352 which are each supported by a respective pair of the bearings 345 and 346. Each of the guide rods 351 and 352 includes a clamp 353 on the upper end thereof wherein the clamps 353 of the guide rods 351 and 352 are joined together by a rigid tubular transverse frame 354.

To maintain the slide assembly 347 at a selected elevation and also effect vertical movement of the slide assembly 347, a drive unit 355 is connected between the support frame 354 and the support rail 340. The drive unit 354 includes a plate 356 which is rigidly attached to the support frame 354. Further, the drive unit 355 includes an upright rectangular plate 357 which is rigidly affixed to a front face 358 of the cross rail 340. The plate 357 includes a motor 359 mounted to a front face thereof wherein the motor 359 includes a motor shaft extending rearwardly through the plate 357 and engaging a crank arm 360 (FIG. 21). The crank arm 360 includes a pin 361 projecting rearwardly therefrom which pin 361 slidably engages a horizontal slot in the plate 356. The drive pin 361 on the crank 360 is offset sidewardly relative to the axis of the motor shaft such that rotation of the crank 360 causes a corresponding vertical movement of the plate 356 and the slide assembly 347 which is engaged therewith. As a result, actuation of the motor 359 causes the slide assembly 347 to move vertically upwardly to the raised position of FIG. 22 or downwardly to the picking position of FIG. 26.

On the bottom ends of the guide rods 351 and 352, a support plate 365 is rigidly attached to provide support for the pick and place units 32. The plate 365 is a rectangular metal plate having four spaced-apart sets of six apertures therethrough. The apertures are adapted to each receive a bearing 366 therein. Each of the pick and place units 32 includes a plurality and preferably six vacuum plungers 368 wherein each vacuum plunger 368 is slidably supported by a respective one of the bearings 366.

Each vacuum plunger 368 comprises a suction cup-like vacuum head 369 which is connected to a rigid hollow tube 370. The upper end of the hollow tube 370 extends upwardly above the mounting plate 365. The hollow tube 370 further includes an upper stop collar 372 which is fixedly attached near the upper tube end 371 as well as a lower stop collar 373 which is fixed to the hollow tube 370 near the vacuum head 369.

Each hollow tube 370 is vertically slidable within the respective bearing 366 while the upper and lower collars 372 and 373 prevent the hollow tube 370 from sliding out of the bearing 366. Further, a coil spring 375 is slidably received on the lower end of the hollow tubing 370 and is confined vertically between a bottom surface of the mounting plate 365 and an upper surface 376 of the lower collar 373. The coil spring 375 is in compression therebetween so as to normally urge the suction head 369 downwardly whereby the upper collar 372 <abuts against the top of the bearing 366. However, when picking a pouch 14 from the transfer bed 22 (FIG. 23) or placing the pouch 14 on the transfer conveyor 28 (FIG. 24), the suction head 369 may contact a surface thereon wherein the arrangement of the spring 375 allows vertical movement or displacement of the vacuum plunger 368.

Each of the vacuum plungers 368 is pneumatically connected to a vacuum hose 380 (FIG. 22). More particularly, each of the vacuum hoses 380 which are omitted from FIG. 23 for clarity, as a lower end connected to the upper tube end 371 and an opposite end which is connected to a respective one of a set of openings 381 formed in a manifold 382. Each manifold 382 further has a supply line 385 (FIG. 22) connected to a manifold connector 383 which line 385 furthermore is connected to a vacuum control unit or valve unit 384. Each vacuum control unit 384 is connected to a vacuum pump and controls application of a vacuum or suction which is created in the suction head 369.

In view of the above, a manifold 382 is provided for each set of six vacuum plungers 368 wherein each set of plungers 368 comprises the pick and place unit 32. A control unit 384 is connected to each manifold 383. With this arrangement, a vacuum or suction airflow is provided in each suction head 369 wherein each group of six suction heads 369 is provided to pick up a respective one of the pouches 14 from the transfer bed.

The control units 384 also shut off the vacuum flow when the suction heads 369 reach the horizontal orientation of FIG. 24 and moved toward the transfer conveyor 28, at which time the pouches 14 are placed onto the transfer conveyor 28.

Figure 23:
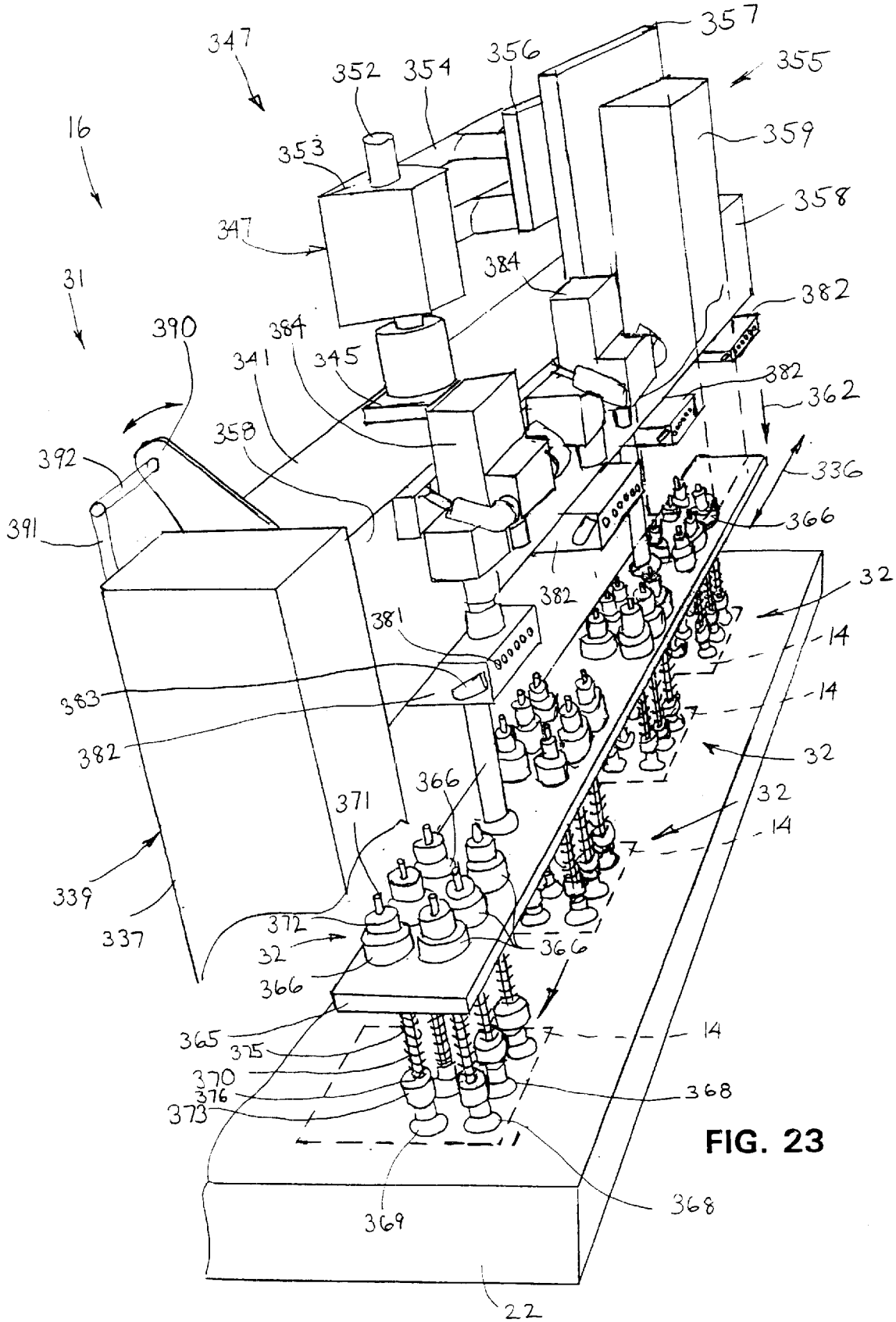
FIG. 23 is a side perspective view of the pick and place machine and the transfer table.

To effect 90 degree rotation of the pick and place units 32, the support rail 341 includes a drive arm 390 which projects upwardly at an angle. The drive arm 390 is connected to a drive rod 391 by a transverse spacer 392 as seen in FIG. 23. Referring to FIG. 22, the drive rod 391 is connected to a crank 393 which said crank 393 is rotatably driven by a drive motor 394 that is supported on the motor mount 340.

Therefore, by actuation of the motor 394, the support rail 340 and the pick and place units 32 connected thereto may be rotated from the downward extending pick position of FIG. 23 to the sideward extending place position of FIG. 24.

Figure 30:
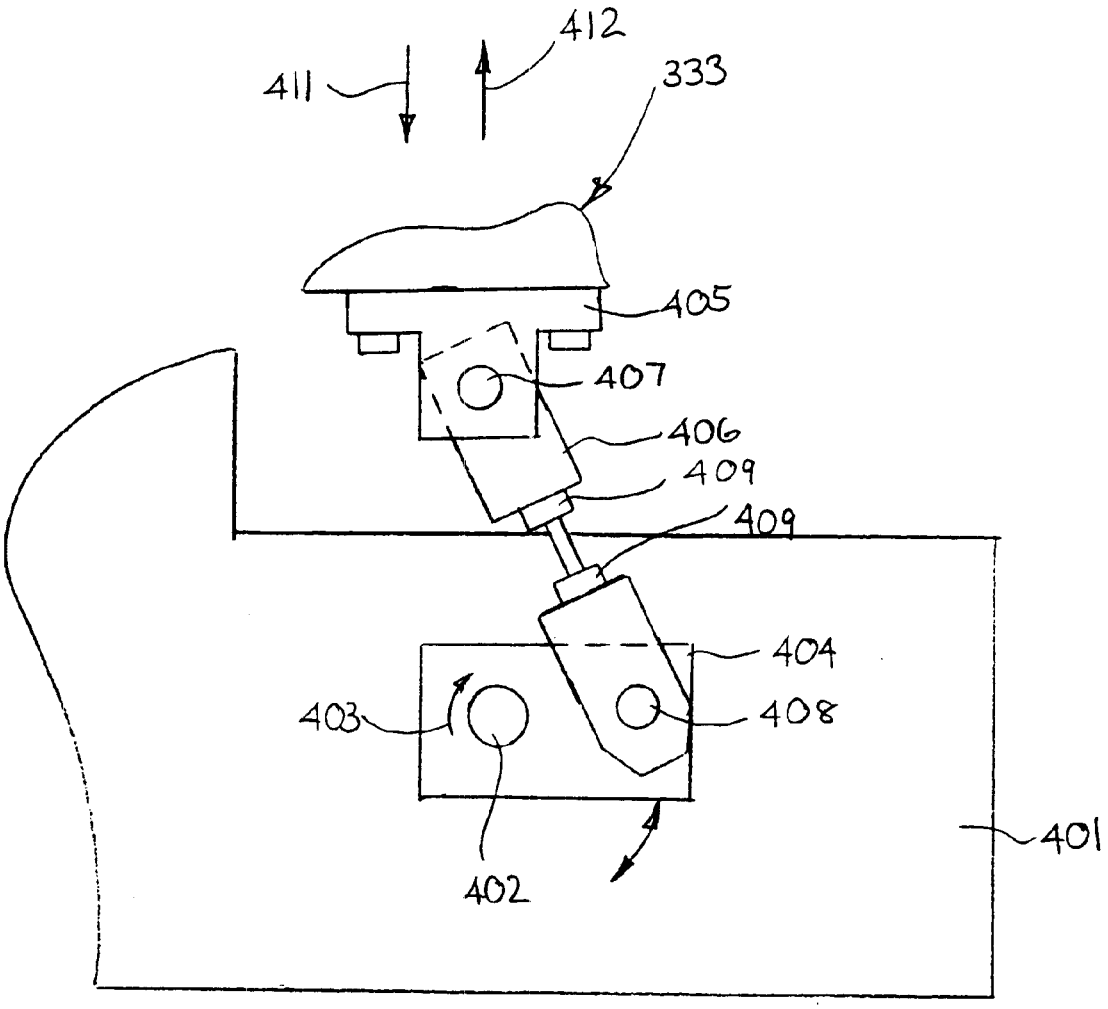
FIG. 30 is a partial top plan view of a drive mechanism for effecting translational movement of the pick and place machine.

In addition to the foregoing, the pick and place carrier 333 is transversely slidable by the drive unit 335. The drive unit 335 as illustrated in FIGS. 22 and 30, includes a drive motor 400 which is connected to a motor mount 401 that is supported on the frame plate 331. The drive motor 400 includes a drive shaft 402 which projects upwardly through the motor mount 401 and is rotatable in the direction of reference arrow 403. The drive shaft 402 is connected to a crank block 404 which crank block 404 is connected to a bracket 405 on the carrier 333 by an intermediate drive link 406.

The drive link 406 has the opposite ends thereof connected to the bracket 405 and the crank arm 404 by respective connector pins 407 and 408. The connector link 406 further includes threaded adjustment nuts 409 which allow for adjustment of the longitudinal distance between the drive pins 407 and 408.

During rotation of the shaft 402, the carrier 333 initially is pulled in the direction of reference arrow 411 in an upstream direction and then as the crank 404 passes over center, the carrier is moved in the downstream direction indicated by reference arrow 412. The movement of the carrier 333 in the downstream direction 412 is timed or synchronized so that the carrier 333 moves downstream at the same speed as the conveyor belt 29 so that as the pouches 14 are placed on the belt 29, a continuous simultaneous movement occurs between the pick and place devices 32 and the conveyor belt 29.

More particularly referring to FIGS. 25 through 28, the pick and place process is illustrated therein. FIG. 25 illustrates the pick and place units 32 in a raised pick position at which time, the initial feed belts 313 move the stock 21 of pouches 14 along the feed chute 310. At the beginning of the pick and place sequence, the leading pouch 14 is pulled from the stock 21 by the feed belt 322 and moved forwardly by the feed paddle 326.

Figure 26:
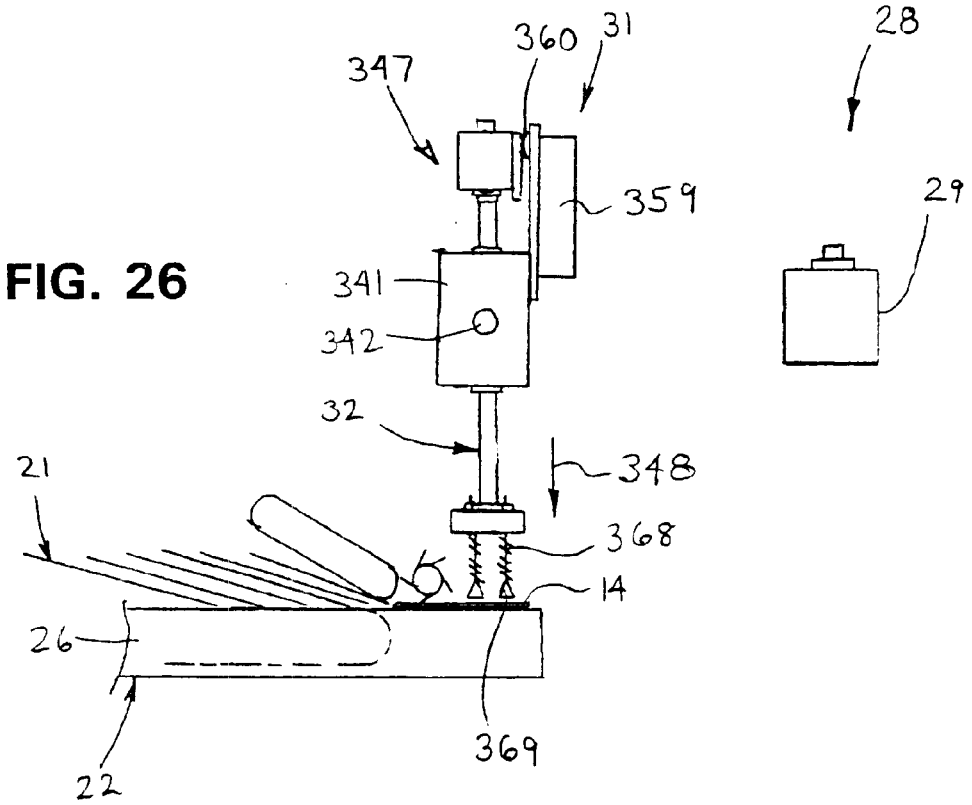
FIG. 26 is a side view illustrating the pick and place machine picking a pouch from the transfer table.

Next, referring to FIG. 26, the motor 359 is operated to move the slide assembly 347 downwardly which moves the plunger unit 368 into contact with a respective one of the four pouches 14. FIG. 23 also illustrates the four pouches 14 after movement of the pick and place units 32 downwardly in the direction of reference arrow 362. The suction flow created in the suction heads 369 thereby causes the pouch 14 to be picked up and held on the slide assembly 347. Thereafter, the motor 359 is actuated to raise the slide assembly 347 to the raised position generally illustrated in FIG. 25.

Figure 27:
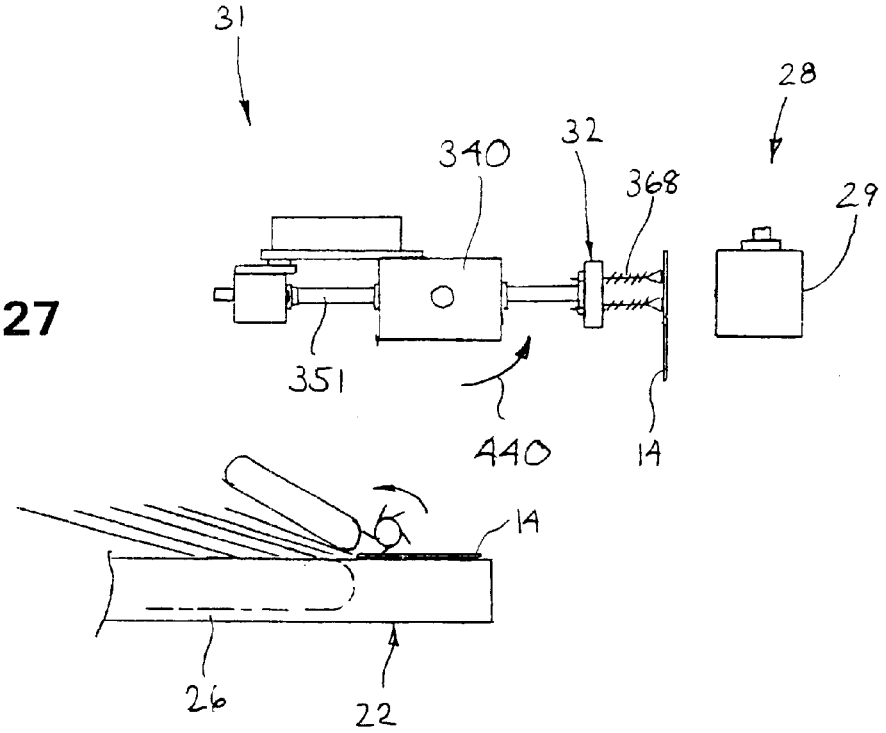
FIG. 27 is a side elevational view illustrating the pick and place machine rotated to a place position.

Referring to FIG. 27, the drive motor 394 (FIG. 22) next is actuated to rotate the carrier rail 340 90 degrees in the direction of reference arrow 440 at which time the guide rods 351 and 352 are oriented horizontally and the pouch 14 held on the vacuum plungers 368 hangs downwardly in a vertical orientation. At this time, the main drive motor 400 (FIG. 22) also is actuated to first pull the carrier rail 340 and the attached pick and place units 32 in the upstream direction 411 (FIG. 30) and then as the crank 404 rotates past the over center position, the carrier unit 333 then moves in the downstream direction 412. This downstream movement is simultaneous in time and speed with the downstream movement of four of the aperture groupings 306. In particular, each pouch 14 which is held on the pick and place units 32 is aligned and moves simultaneously downstream with a respective one of the aperture groupings 306 as generally illustrated in FIG. 21.

Figure 28:
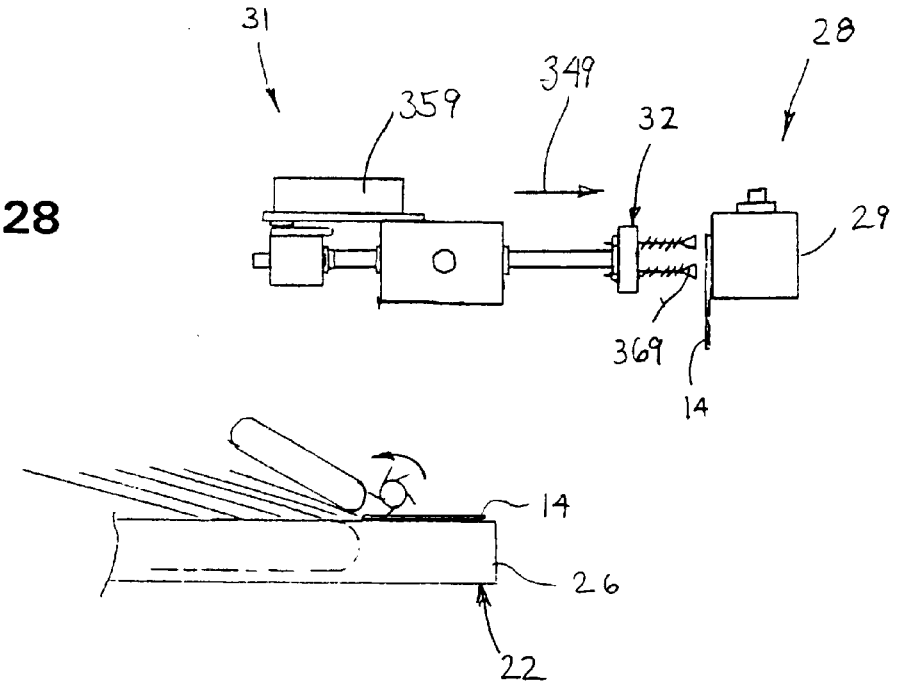
FIG. 28 is a side elevational view illustrating the pick and place machine positioning a pouch on the conveyor belt unit.

Referring to FIG. 28, during this downstream movement, the motor 359 again is actuated to shift the pick and place units 32 horizontally towards the transfer conveyor generally in the direction of reference arrow 349 (FIG. 28). This causes the pouch 14 to contact the transfer conveyor 29. At this time, the suction in the plunger heads 369 is shut off, while the suction acting through the aperture groupings 306 retains the pouches 14 on the transfer conveyor 29. Then, the motor 359 is operated to separate the pick and place units 32 from the transfer conveyor 29 and return these units 32 back to the normal position generally illustrated in FIG. 27.

Thereafter, the motor 394 again is operated to swing the pick and place units 32 downwardly to the pick position as generally indicated in FIG. 25 and this entire process is continually repeated during operation of the transfer conveyor 29. The timing of the steps illustrated in FIGS. 25 through 28 corresponds to the time that each successive set of four aperture groupings 306 traverses in the downstream direction such that each adjacent aperture grouping 306 receives a pouch 14 and passes the pouch 14 sequentially downstream to the remaining roller drum apparatus in a continuous uninterrupted process.

Preferably, a programmable logic controller (PLC) or other control unit is connector to the various motors, vacuum papers, and valve units to control the above-described operation.

Although a particular embodiment of the invention has been disclosed in detail for illustrative purposes, it will be recognized that variations or modifications of the disclosed apparatus, including the rearrangement of parts, lie within the scope of the present invention.

What is claimed is:

1. A pouch-filling method comprising the following steps:

providing a plurality of empty pouches which have an open upper end defined by upper pouch edges and have releasable lock strips which extend in a transverse direction, said releasable lock strips being spaced downwardly from said upper pouch edges;

providing a carrier unit having a plurality of pouch carriers which move transversely one after the other along a pouch path;

gripping opposite side edges of each of said pouches by a respective one-of said carriers;

moving said carriers in said transverse direction to move said pouches continuously along said pouch path;

providing a pouch-opening apparatus having a first stage for exposing said releasable lock strips and a second stage for disengaging said releasable lock strips;

pulling said upper pouch edges outwardly away from each other in said first stage to expose said releasable lock strips;

after said pulling of said upper pouch edges, gripping said upper pouch edges adjacent to said releasable lock strips in said second stage by front and rear grippers and moving said front and rear grippers outwardly a way from said pouch path to separate said releasable lock strips and open said pouch;

holding said pouch open by said carrier; and transporting said opened pouch from said pouch-opening apparatus to a filling station.

2. The pouch-filling method according to claim 1, wherein said grippers include inner jaws, said method further comprising the step of inserting said inner jaws downwardly between said upper pouch edges.

3. The pouch-filling method according to claim 2, wherein said downward movement of said inner jaws partially separates said releasable lock strips.

4. The pouch-filling method according to claim 2, wherein said grippers further include outer jaws, said method further including the steps of moving said outer jaws laterally on opposite sides of said pouch path, aligning said inner jaws with said outer jaws for gripping of said upper pouch edges, and simultaneously moving each pair of inner and outer jaws laterally and outwardly away from said pouch path to permit continuous movement of said pouch during opening thereof.

5. A pouch-filling machine for filling pouches with a filler material comprising:

a filling apparatus;

a carrier unit having a plurality of pouch carriers wherein each of said carriers supports a pouch and transfers said pouch to said filling apparatus along a pouch path which extends in a lateral direction, said pouch having an upper end defined by upper pouch edges and including resealable lock strips extending laterally along said upper pouch edges, said carriers being continuously moved one after the other along said pouch path to said filling apparatus; and a pouch-opening apparatus disposed along said pouch path for opening said pouches upstream of said filling apparatus, said pouch-opening apparatus comprising a base unit which includes at least one pair of front and rear outer jaws, said front and rear outer jaws being spaced apart on opposite front and rear sides of said pouch path and being laterally movable along diverging jaw paths which extend outwardly away from said pouch path, said pouch-opening apparatus further including a spreader assembly which is movable laterally along said pouch path adjacent to said pouch, said spreader assembly including front and rear inner jaws which extend downwardly between said upper pouch edges and are respectively aligned with said front and rear outer jaws, said inner jaws moving laterally and outwardly along said jaw paths in unison with said outer jaws to effect a continuous gripping and opening of said upper pouch edges.

6. The pouch-filling machine according to claim 5, wherein said inner jaws are vertically movable such that said inner jaws are movable downwardly between said upper pouch edges for gripping and are movable upwardly after opening of said upper pouch edges.

7. The pouch-filling machine according to claim 6, wherein said pouch includes a flexible upper edge section which extends upwardly from said resealable closure strips, said base unit further including a vacuum unit having vacuum ports on said front and rear sides of said pouch path for separating said upper edge sections to permit insertion of said inner jaws downwardly therebetween, said outer jaws being disposed downstream of said vacuum unit.

8. The pouch-filling machine according to claim 7, wherein said front and rear vacuum ports are movable laterally along diverging vacuum paths.

9. The pouch-filling machine according to claim 6, wherein said pouch-opening apparatus includes a cam track which extends along said pouch path, said cam track including a declined ramp, a generally horizontal track section at the bottom of said declined rampant, and an inclined ramp at a downstream end of said linear track section which extends upwardly therefrom, said spreader assembly including a first cam follower which travels along said cam track for lowering said inner jaws to lowered position and then raising said inner jaws to a raised position, said spreader assembly including a second cam follower which contacts a cam actuator to spread said inner jaws apart when in said lowered position to effect opening of said inner jaws.

10. The pouch-filling machine according to claim 5, wherein said resealable closure strips are defined by a mating pair of connector strips which define a zipper type lock.

11. The pouch-filling machine according to claim 5, wherein each of said jaw paths extends laterally and outwardly such that each said jaw path is substantially linear and extends at an angle relative to said pouch path.

12. A pouch-filling machine for filling pouches with a filler material comprising:

a filling apparatus;

a carrier unit having a plurality of pouch carriers which are movable one after the other in a lateral direction, each of said carriers supporting a pouch and transferring said pouch to said filling apparatus along a pouch path, said pouch having an open upper end that includes a resealable closure strip arrangement which extends laterally across said pouch for sealing said upper end and flexible pouch edges along an upper margin thereof which extend upwardly away from said closure strip arrangement, said carrier unit have a drive unit which moves said carriers continuously along said pouch path to said filling apparatus for filling of said pouches; and a pouch-opening apparatus disposed along said pouch path for unsealing said closure strip arrangement and opening said pouches prior to said filling apparatus, said pouch-opening apparatus including a first stage for separating said pouch edges and a second stage for spreading said pouch edges to disengage and unseal said closure strip arrangement, said first stage including front and rear pulling parts which move laterally in combination with an adjacent one of said pouches and pull said pouch edges outwardly to provide access to said pouch edges, said second stage including a pair of front and rear grippers which move laterally in combination with said adjacent pouch on opposite front and rear sides of said pouch path, said grippers having at least inner jaws which move downwardly between said pouch edges for gripping thereof and said grippers being movable outwardly away from each other to pull said pouch edges and open said closure strips during simultaneous lateral movement of said gripper and said pouch.

13. The pouch-filling machine according to claim 12, wherein said inner jaws cooperate with a corresponding pair of outer jaws of said grippers for gripping said pouch edges, said outer jaws moving laterally along a generally horizontal path.

14. The pouch-filling machine according to claim 13, wherein said inner jaws are movable downwardly to an inserted position in which said inner jaws separate a portion of said closure strips, said inner jaws when in said inserted position moving laterally in unison with said outer jaws for gripping said pouch edges.

15. The pouch-filling machine according to claim 14, wherein each of said inner jaws moves laterally and outwardly away from said pouch path in parallel with said outer jaw corresponding thereto to define a pouch path and permit continuous lateral movement of said pouch during gripping and opening of said pouch edge.

16. The pouch-filling machine according to claim 15, wherein said jaw paths of said front and rear grippers diverge.

17. The pouch-filling machine according to claim 13, wherein said first stage includes a pair of front and rear vacuum ports which are movable laterally in unison with said adjacent pouch, said front and rear vacuum ports providing a section on opposite sides of said adjacent pouch to pull said pouch edges apart.

18. The pouch-filling machine according to claim 17, wherein each of said vacuum ports are defined on a first annular member, and each of said outer jaws is defined on a second annular member disposed downstream of said first annular member, said first and second annular members being driven rotatably together wherein rotation of one of said first and second annular members rotates the remaining ones of said first and second annular members to effect synchronous lateral movement of said vacuum ports and said outer jaws.

19. The pouch-filling machine according to claim 12, wherein said pouch-opening apparatus further includes a spreader assembly which includes said inner jaws and is movable laterally along said pouch path adjacent to said one pouch, said pouch-opening apparatus including a cam track which extends along said pouch path, said cam track including a declined ramp, a linear track section at the bottom of said declined rampant, and an inclined rampant which extends upwardly from a downstream end of said linear track section, said spreader assembly including a first cam follower which travels along said cam track for lowering said inner jaws to a lowered position for insertion between said pouch edges and then raising said inner jaws after opening of said pouch.

20. The pouch-filling machine according to claim 19, wherein said spreader assembly includes a second cam follower which contacts a cam actuator during lateral movement of said spreader assembly to effect opening of said inner jaws when in said lowered position, said inner jaws being spread outwardly away from each other for gripping said upper pouch edges between said outer jaws and said inner jaws to open said closure strips prior to filling.

* * * * *